US012428248B2

(12) United States Patent
Tanaka et al.

(10) Patent No.: US 12,428,248 B2
(45) Date of Patent: Sep. 30, 2025

(54) SHEET PROCESSING APPARATUS, IMAGE FORMING APPARATUS, AND IMAGE FORMING SYSTEM

(71) Applicants: Yusuke Tanaka, Kanagawa (JP); Kentaroh Fukami, Kanagawa (JP); Shigeyuki Itoh, Kanagawa (JP); Atsushi Kuriyama, Kanagawa (JP); Yuuki Nakagawa, Kanagawa (JP); Yiru Chen, Kanagawa (JP); Ken Sawada, Kanagawa (JP); Takuya Fukuhara, Kanagawa (JP); Ryoh Suzuki, Kanagawa (JP); Yasuo Ohba, Kanagawa (JP); Akikazu Iwata, Kanagawa (JP)

(72) Inventors: Yusuke Tanaka, Kanagawa (JP); Kentaroh Fukami, Kanagawa (JP); Shigeyuki Itoh, Kanagawa (JP); Atsushi Kuriyama, Kanagawa (JP); Yuuki Nakagawa, Kanagawa (JP); Yiru Chen, Kanagawa (JP); Ken Sawada, Kanagawa (JP); Takuya Fukuhara, Kanagawa (JP); Ryoh Suzuki, Kanagawa (JP); Yasuo Ohba, Kanagawa (JP); Akikazu Iwata, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 167 days.

(21) Appl. No.: 18/356,639

(22) Filed: Jul. 21, 2023

(65) Prior Publication Data

US 2024/0034580 A1 Feb. 1, 2024

(30) Foreign Application Priority Data

Jul. 26, 2022 (JP) ..... 2022-118862

(51) Int. Cl.
*B65H 29/70* (2006.01)
*B65H 5/06* (2006.01)

(52) U.S. Cl.
CPC ..... *B65H 5/062* (2013.01); *B65H 2402/44* (2013.01); *B65H 2403/94* (2013.01);
(Continued)

(58) Field of Classification Search
CPC ..... B65H 5/062; B65H 2404/1431; B65H 2404/143; B65H 2404/144;
(Continued)

(56) References Cited

U.S. PATENT DOCUMENTS

2005/0194730 A1 9/2005 Nishida et al.
2009/0200725 A1 8/2009 Tamura et al.
(Continued)

FOREIGN PATENT DOCUMENTS

JP 2002274689 A * 9/2002
JP 2007-131455 5/2007
(Continued)

OTHER PUBLICATIONS

U.S. Appl. No. 18/004,543, filed Aug. 18, 2021, Atsushi Kuriyama, et al.

*Primary Examiner* — Luis A Gonzalez
(74) *Attorney, Agent, or Firm* — IPUSA, PLLC

(57) ABSTRACT

A sheet processing apparatus includes a first guide plate and a second guide plate facing with a given space in a thickness direction and having second and third openings, a sheet conveyance passage between the first and second guide plates, and a sheet conveyor including a drive source, a drive roller, a first driven roller, and a second driven roller. The drive roller protrudes from the first guide plate toward the sheet conveyance passage through the first opening. The first driven roller faces the drive roller and protrudes from the
(Continued)

second guide plate toward the sheet conveyance passage through the second opening. The second driven roller protrudes from the second guide plate toward the sheet conveyance passage through the third opening. The second driven roller is disposed at a position shifted from the drive roller in a width direction orthogonal to the sheet conveyance direction and the thickness direction.

15 Claims, 17 Drawing Sheets

(52) U.S. Cl.
CPC .. *B65H 2404/6111* (2013.01); *B65H 2801/03* (2013.01); *B65H 2801/24* (2013.01)

(58) Field of Classification Search
CPC .... B65H 2404/1451; B65H 2404/1341; B65H 2404/1342; B65H 2404/13421; B65H 29/70; B65H 29/12; B65H 29/125
See application file for complete search history.

(56) References Cited

U.S. PATENT DOCUMENTS

| | | | |
|---|---|---|---|
| 2009/0206547 | A1 | 8/2009 | Tokita et al. |
| 2009/0258774 | A1 | 10/2009 | Suzuki et al. |
| 2009/0283961 | A1 | 11/2009 | Saito et al. |
| 2010/0019435 | A1 | 1/2010 | Fukami |
| 2010/0148417 | A1 | 6/2010 | Suzuki et al. |
| 2010/0149299 | A1 | 6/2010 | Nishida et al. |
| 2010/0207314 | A1 | 8/2010 | Hattori et al. |
| 2010/0237556 | A1 | 9/2010 | Azuma et al. |
| 2011/0074081 | A1 | 3/2011 | Hirabayashi et al. |
| 2011/0127709 | A1* | 6/2011 | Katayama ..... G03G 15/6558 271/9.13 |
| 2011/0133399 | A1* | 6/2011 | Katayama ..... G03G 15/6529 271/272 |
| 2012/0217693 | A1 | 8/2012 | Fukami |
| 2013/0161899 | A1 | 6/2013 | Ito et al. |
| 2014/0141956 | A1* | 5/2014 | Suzuki ..... B65H 45/14 493/454 |
| 2015/0037119 | A1 | 2/2015 | Tanaka et al. |
| 2015/0321871 | A1 | 11/2015 | Nakagawa et al. |
| 2015/0329308 | A1 | 11/2015 | Iwata et al. |
| 2015/0329309 | A1 | 11/2015 | Iwata et al. |
| 2015/0336765 | A1 | 11/2015 | Sawada et al. |
| 2017/0267483 | A1 | 9/2017 | Sawada et al. |
| 2017/0341885 | A1 | 11/2017 | Suzuki et al. |
| 2018/0370751 | A1 | 12/2018 | Sawada et al. |
| 2020/0071118 | A1 | 3/2020 | Sawada et al. |
| 2020/0172367 | A1 | 6/2020 | Tanoue et al. |
| 2020/0231401 | A1 | 7/2020 | Fukuhara et al. |
| 2020/0239263 | A1 | 7/2020 | Hirako et al. |
| 2022/0063953 | A1 | 3/2022 | Tanaka et al. |
| 2022/0297963 | A1 | 9/2022 | Suzuki et al. |
| 2023/0024014 | A1 | 1/2023 | Mochizuki et al. |

FOREIGN PATENT DOCUMENTS

| | | |
|---|---|---|
| JP | 2007-153603 | 6/2007 |
| JP | 2007-182262 | 7/2007 |
| JP | 2008-162708 | 7/2008 |

* cited by examiner

SHEET PROCESSING APPARATUS, IMAGE FORMING APPARATUS, AND IMAGE FORMING SYSTEM

CROSS-REFERENCE TO RELATED APPLICATION

This patent application is based on and claims priority pursuant to 35 U.S.C. § 119(a) to Japanese Patent Application No. 2022-118862, filed on Jul. 26, 2022, in the Japan Patent Office, the entire disclosure of which is hereby incorporated by reference herein.

BACKGROUND

Technical Field

Embodiments of the present disclosure relate to a sheet processing apparatus, an image forming apparatus, and an image forming system.

Background Art

Various types of sheet processing apparatuses are known that perform post-processing operations including an alignment operation for aligning a bundle of overlaid sheet-shaped recording media ("sheets") and a sheet folding operation for folding a sheet or a bundle of sheets. Sheets having different thicknesses and stiffnesses pass through a sheet conveyance passage in such a sheet processing apparatus. By overlaying or folding the sheets into sheet bundles having different thicknesses, those sheet bundles pass through the sheet conveyance passage in the sheet processing apparatus.

For example, a sheet processing apparatus in the art has a configuration in which a drive roller and a driven roller are pressed against each other and convey a sheet while nipping the sheet. When the sheet is jammed in a sheet conveyance passage, the contact pressure between the drive roller and the driven roller are released to remove the sheet from the sheet conveyance passage. Further, to obtain a good recording image quality by reducing occurrence of lifting of a sheet serving as a recording medium, another sheet processing apparatus in the art has a configuration in which an additional driven roller is disposed between two driven rollers that are pressed against a conveyance roller and a groove is provided at a position where the additional driven roller faces the conveyance roller.

In the sheet processing apparatus having the above-described configuration, there is a problem in that the sheet comes into contact with the guide plate that defines the conveyance path and the conveyance resistance of the sheet increases. When the sheet is conveyed while being in contact with the guide plate, the sheet may be damaged or wrinkled.

However, in the technique of Patent Document 1, the conveyance is interrupted in order to remove the sheet jammed in the conveyance path, and the problem described above cannot be solved. Further, in the technique of Patent Document 2, since the sheet is waved in the conveying direction by the groove provided in the conveying roller, it is difficult to say that the occurrence of wrinkles in the sheet can be prevented.

SUMMARY

Embodiments of the present disclosure described herein provide a novel sheet processing apparatus including a first guide plate, a second guide plate, a sheet conveyance passage, and a sheet conveyor. The first guide plate has a first opening. The second guide plate is disposed facing the first guide plate with a given space in a thickness direction of a sheet and has a second opening and a third opening. The sheet conveyance passage is between the first guide plate and the second guide plate. The sheet conveyor conveys the sheet along the sheet conveyance passage in a sheet conveyance direction. The sheet conveyor includes a drive roller, a first driven roller, and a second driven roller. The drive roller protrudes from the first guide plate toward the sheet conveyance passage through the first opening. The first driven roller is disposed facing the drive roller and protrudes from the second guide plate toward the sheet conveyance passage through the second opening. The second driven roller protrudes from the second guide plate toward the sheet conveyance passage through the third opening. The second driven roller is disposed at a position shifted from the drive roller in a width direction orthogonal to the sheet conveyance direction and the thickness direction.

Further, embodiments of the present disclosure described herein provide an image forming apparatus including the above-described sheet processing apparatus and an image former to form an image on the sheet. The above-described sheet processing apparatus performs a post-processing operation on the sheet on which the image is formed by the image former.

Further, embodiments of the present disclosure described herein provide an image forming system including the above-described sheet processing apparatus and an image forming apparatus coupled to the sheet processing apparatus. The image forming apparatus forms an image on the sheet.

BRIEF DESCRIPTION OF THE SEVERAL VIEWS OF THE DRAWINGS

Exemplary embodiments of this disclosure will be described in detail based on the following figures, wherein.

Figure 1:
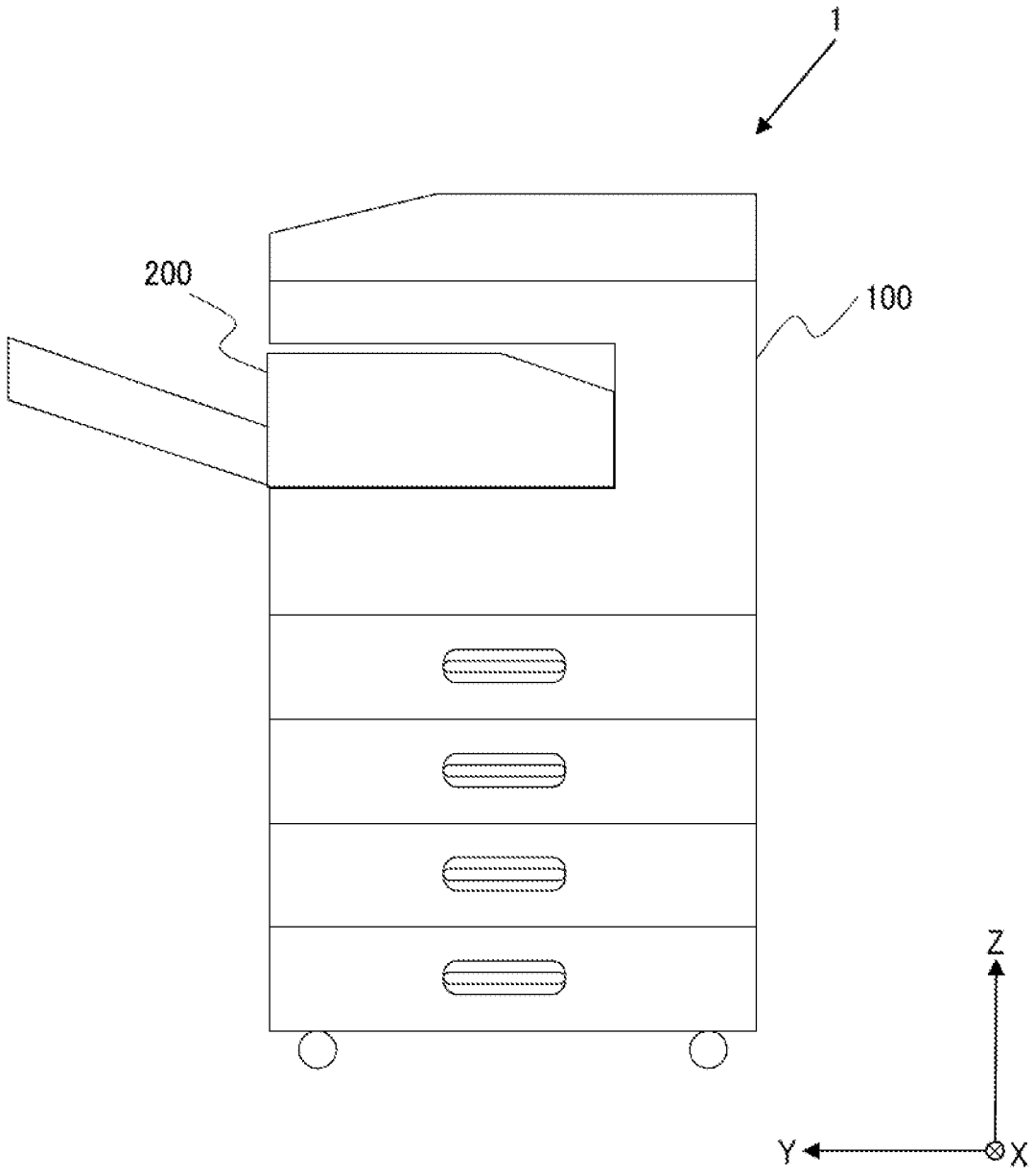
FIG. 1 is a side view of an image forming system according to an embodiment of the present disclosure, where the image forming system includes a sheet processing apparatus and an image forming apparatus, according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on," "directly connected to" or "directly coupled to" another element or layer, then there are no intervening elements or layers present. As used herein, the term "connected/coupled" includes both direct connections and connections in which there are one or more intermediate connecting elements. Like numbers refer to like elements throughout. As used herein, the term "and/or" includes any and all combinations of one or more of the associated listed items.

Spatially relative terms, such as "beneath," "below," "lower," "above," "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

The terminology used herein is for describing particular embodiments and examples and is not intended to be limiting of exemplary embodiments of this disclosure. As used herein, the singular forms "a," "an," and "the" are intended to include the plural forms as well, unless the context clearly indicates otherwise. It will be further understood that the terms "includes" and/or "including," when used in this specification, specify the presence of stated features, integers, steps, operations, elements, and/or components, but do not preclude the presence or addition of one or more other features, integers, steps, operations, elements, components, and/or groups thereof.

Referring now to the drawings, embodiments of the present disclosure are described below. In the drawings for explaining the following embodiments, the same reference codes are allocated to elements (members or components) having the same function or shape and redundant descriptions thereof are omitted below.

A description is given of an image forming apparatus according to an embodiment of the present disclosure.

First Embodiment of Image Forming System

A description is given of an image forming system according to a first embodiment of the present disclosure.

FIG. 1 is a side view of an outward appearance of an image forming system 1 according to an embodiment of the present disclosure, where the image forming system includes a sheet processing apparatus and an image forming apparatus, according to an embodiment of the present disclosure.

The image forming system 1 according to the present embodiment includes an image forming apparatus 100 serving as an image former and a sheet folder 200 serving as a sheet processing apparatus. The sheet folder 200 is a unit that operates in cooperation with the image forming apparatus 100. The image forming apparatus 100 illustrated in FIG. 1 is an in-body ejection type. The image forming apparatus 100 has a feature of making the sheet folder 200 selectable as an ejection destination of the recording medium (sheet P) having an image on the surface.

The sheet folder 200 serving as a sheet processing apparatus according to an embodiment of the present disclosure has a feature of making a sheet bundle Q that is multiple sheets P overlaid with each other. As described below, the sheet folder 200 includes a circulation mechanism that circulates and overlays the sheets P to make the sheet bundle Q. The internal configuration of the sheet folder 200 to execute the features is described below.

Second Embodiment of Image Forming System

Figure 2:
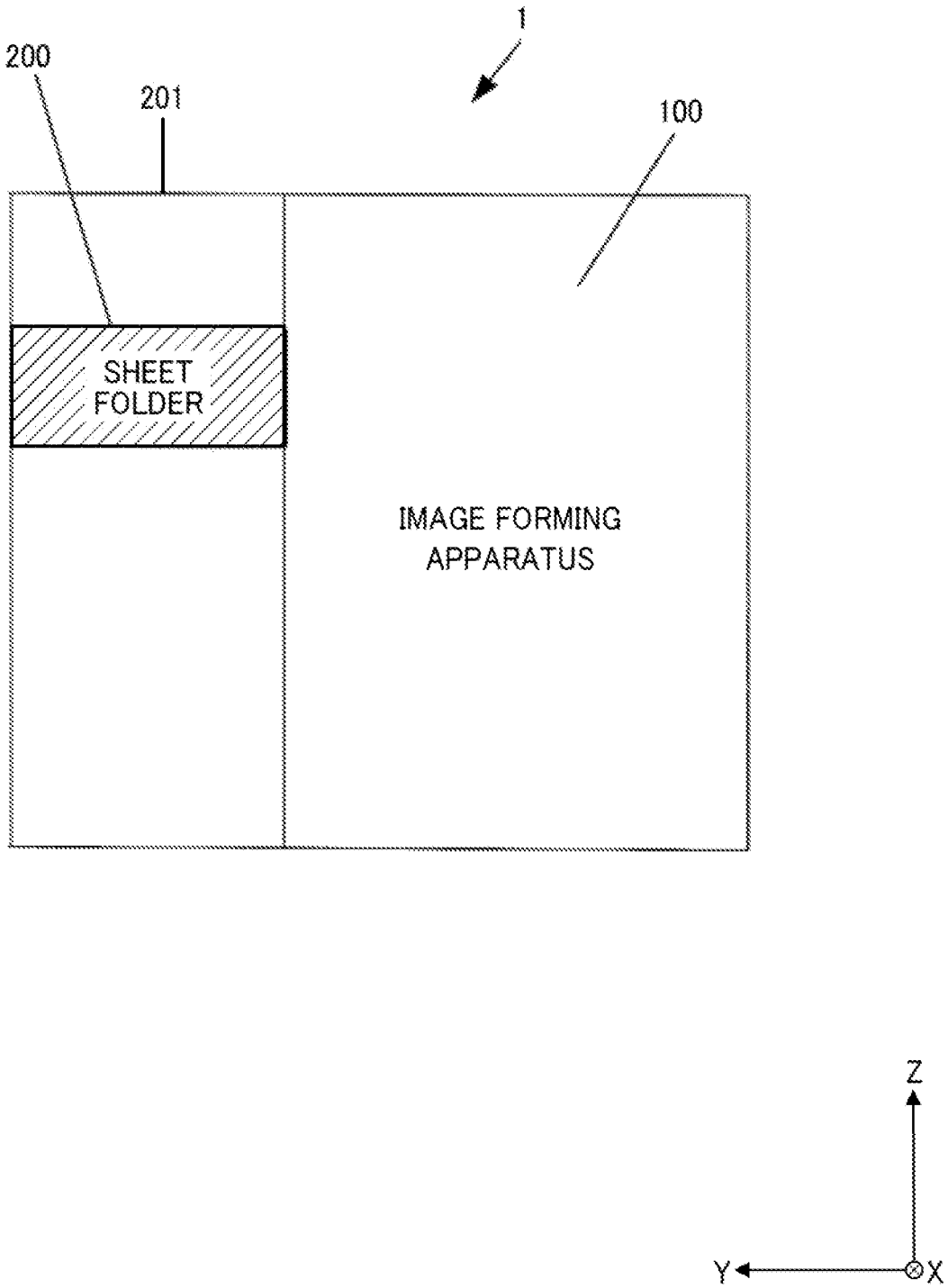
FIG. 2 is a diagram illustrating a schematic configuration of the image forming system including a post-processing apparatus as the sheet processing apparatus and the image forming apparatus, according to an embodiment of the present disclosure.

FIG. 2 is a diagram illustrating a schematic configuration of an image forming system 1 according to a second embodiment of the present disclosure.

The image forming system 1 according to the present embodiment is configured by connecting the image forming apparatus 100 as an image former and the post-processing apparatus 201 including the sheet folder 200 as a sheet processing apparatus. The image forming apparatus 100 and the sheet folder 200 are connected to each other. The image forming system 1 operates such that the sheets P on which an image is formed by the image forming apparatus 100 is conveyed to the sheet folder 200 of the post-processing apparatus 201 and a predetermined sheet folding operation is executed on the sheets P in the sheet folder 200.

Functional Configuration of Control Block

Figure 3:
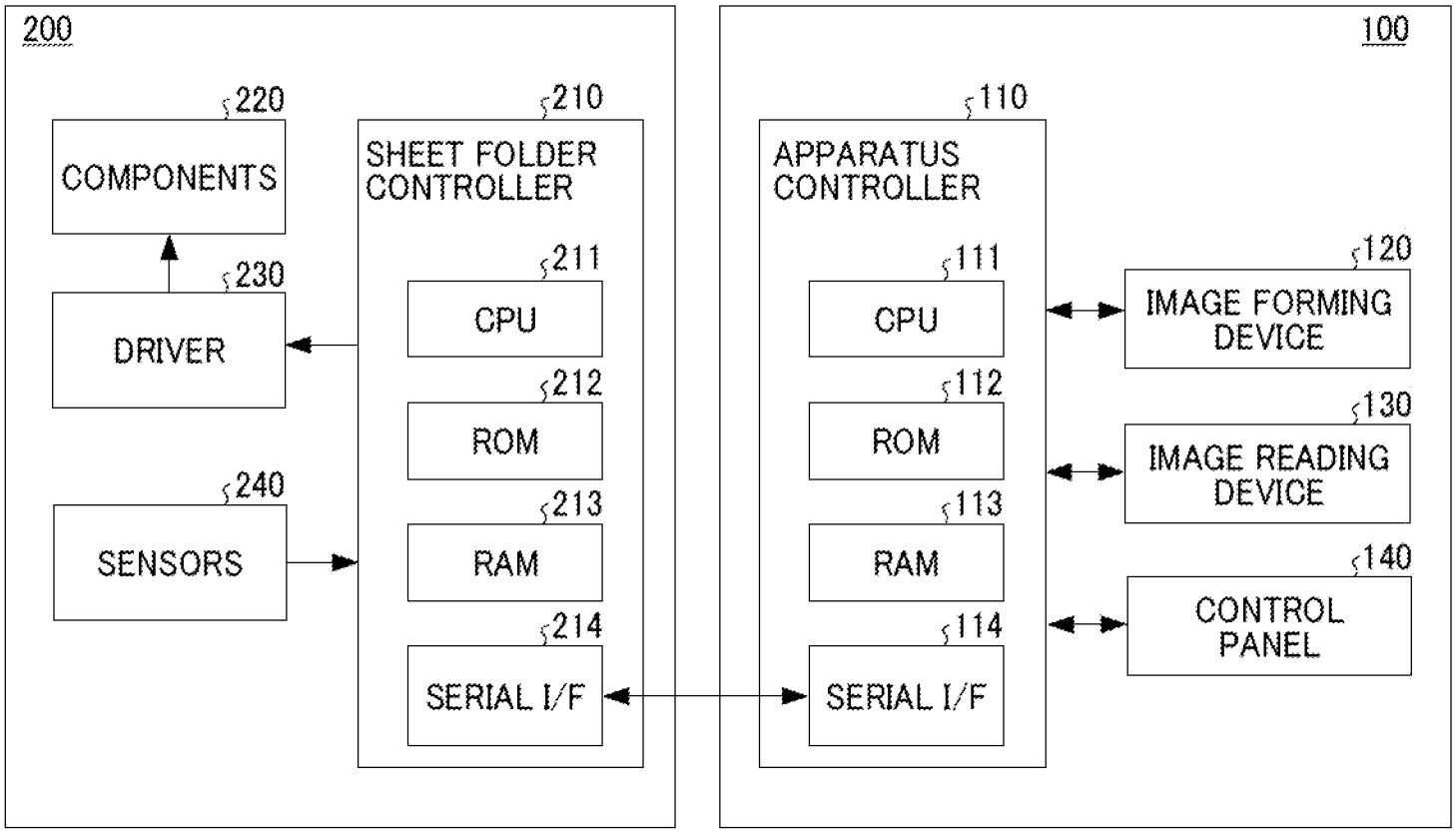
FIG. 3 is a block diagram illustrating a control configuration of the image fonning system according to an embodiment of the present disclosure.

A description is given of the control block that controls the operations of the image forming apparatus 100 and the sheet folder 200 serving as a sheet processing apparatus, according to the present embodiment, with reference to FIG. 3.

FIG. 3 is a block diagram illustrating the control configuration of the image forming system 1 of FIG. 2.

As illustrated in FIG. 3, the image forming apparatus 100 includes an apparatus controller 110 as a control block. The apparatus controller 110 includes a central processing unit (CPU) 111, a read-only memory (ROM) 112, a random access memory (RAM) 113, and a serial interface (serial I/F) 114.

The apparatus controller 110 is connected to an image forming device 120, an image reading device 130, and a control panel 140. Each of the image forming device 120, the image reading device 130, and the control panel 140 includes components to fully perform the functions. Each component of the image forming device 120, the image reading device 130, and the control panel 140 operates based on a control signal issued by the apparatus controller 110.

The image forming device 120 performs an image forming operation based on image data on a sheet P that serves as a recording medium or a sheet-like recording medium. The image reading device 130 reads an image formed on the sheet P and acquires the image data of the image on the sheet P. The control panel 140 serves as an input unit via which operating conditions in the image forming device 120 and the image reading device 130 are input and as a display unit that displays, for example, the operation results.

The control panel 140 also serves as a display unit related to processing contents executed by the sheet folder controller 210 (sheet folder controller) and an input unit that receives input of setting information for controlling the operation (behavior) of the sheet folder 200.

The ROM 112 stores control programs for controlling the image forming device 120, the image reading device 130, and the control panel 140. The CPU 111 reads the control programs stored in the ROM 112 to the RAM 113. Then, the CPU 111 stores data in the RAM 113 to use the data for the control and executes the control defined by the control programs while using the RAM 113 as a work area.

As illustrated in FIG. 3, the sheet folder 200 includes the sheet folder controller 210 as a control block. The sheet folder controller 210 includes a central processing unit (CPU) 211, a read-only memory (ROM) 212, a random access memory (RAM) 213, and a serial interface (serial I/F) 214.

The sheet folder controller 210 is connected to various components 220 and various sensors 240.

The various components 220 are, for example, rollers and roller pairs (pair of rollers) described below. The rollers and roller pairs corresponding to the various components 220 include sheet conveyance roller pairs and sheet folding roller pairs. A drive motor drives the various components 220. For example, the drive motor drives and rotates various rollers and various roller pairs. The sheet folder controller 210 controls a driver 230 to drive the drive motor that drives the various components 220. The various components 220 performs operations such as a conveyance control of the sheet P that serves as the recording medium and a sheet folding operation on the sheet P.

The various sensors 240 are multiple sheet detectors disposed in the sheet conveyance passage in which the sheet P travels, and detect the position of the sheet P in the sheet conveyance passage. Details of the conveyance passage are described below. The sheet P and the sheet bundle Q each serves as an object on which the post-processing operation is performed. The sheet folder controller 210 executes the predetermined control program to determine the conveyance amount and position of the sheet P and the conveyance amount and position of the sheet bundle Q based on detection signals output from the various sensors 240 to the sheet folder controller 210. The sheet folder controller 210 calculates the position of the sheet P based on the amount of movement of the various components 220 and the amount of conveyance (i.e., the distance of conveyance) of the sheet P from when the leading end of the sheet P is detected by the sheet detector.

The ROM 212 stores the control program for the sheet folder controller 210 to perform predetermined processing. The CPU 211 reads the control programs stored in the ROM 212 to the RAM 213. Then, the CPU 211 stores data in the RAM 213 to use the date for the control and executes the control of the sheet folding operation defined by the control programs while using the RAM 213 as a work area. As described above, the sheet folder controller 210 executes the control program stored in the ROM 212, detection of the sheet P and conveyance control on the sheet P can be executed, as described below.

The apparatus controller 110 included in the image forming apparatus 100 and the sheet folder controller 210 included in the sheet folder 200 are communicably connected to each other via the serial I/F 114 and the serial I/F 214. This communication passage is used to exchange control commands and information to be used, for example, for conveyance control of the recording medium, between the apparatus controller 110 and the sheet folder controller 210. The sheet folder 200 determines whether the conveyance control of a recording medium and the sheet folding operations are performed on the sheet P and switches the kinds of the sheet folding operation, based on the control commands and information related to the recording medium both being sent from the image forming apparatus 100 and information related to the position of the sheet P as a recording medium obtained from the various sensors 240.

The information related to the sheet P that is sent from the image forming apparatus 100 (the apparatus controller 110) to the sheet folder 200 (the sheet folder controller 210) includes a plurality of kinds of information. For example, the information includes the sheet type information of multiple sheets such as the kind, thickness, and size of the sheet P to be conveyed from the image forming apparatus 100 to the sheet folder 200. The information related to the sheet P also includes, for example, information indicating the kind of the post-processing operation (for example, whether the post-processing operation is the sheet folding operation or the sheet overlaying operation), information indicating the number of sheets P included in the sheet bundle on which the sheet folding operation is performed, and information indicating the sheet folding position at which the sheet folding operation is performed on the sheet P. The control commands sent from the apparatus controller 110 to the sheet folder controller 210 include a command indicating whether the sheet P that is conveyed is the last page (final sheet) in a unit of which the sheets P to be conveyed are collectively processed, in other words, a command corresponding to the "notification of the start of sheet folding".

Embodiment of Sheet Processing Apparatus

A description is given of the internal configuration of the sheet folder 200 serving as a post-processing apparatus (sheet processing apparatus) according to a first embodiment of the present disclosure.

Figure 4:
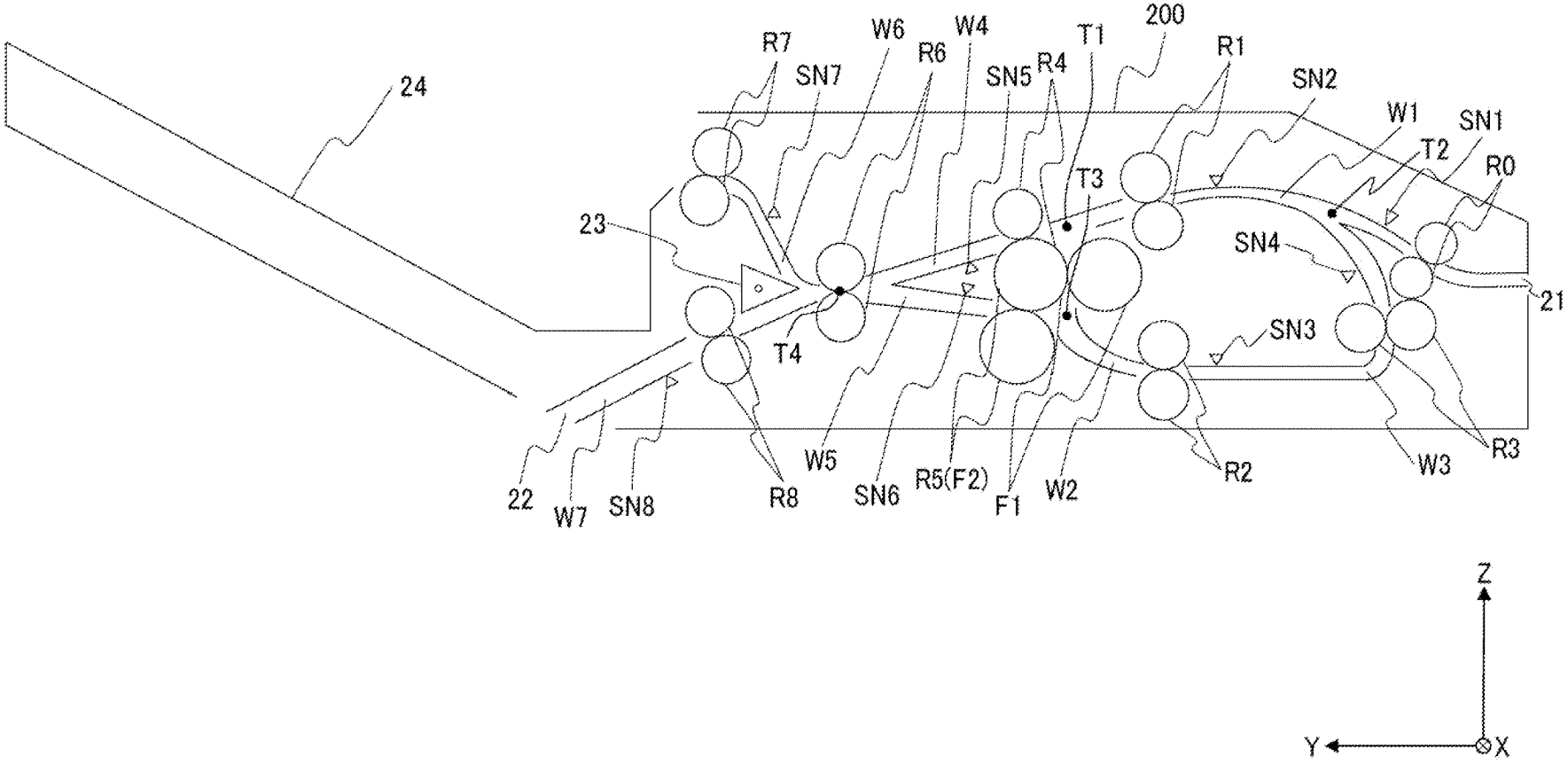
FIG. 4 is a diagram illustrating an internal configuration of a sheet folder serving as the sheet processing apparatus according to an embodiment of the present disclosure.

FIG. 4 is a schematic diagram illustrating the internal configuration of the sheet folder 200.

The sheet folder 200 includes a plurality of sheet conveyors and multiple sheet conveyance passages. The plurality of sheet conveyors circulate the sheets P to make the sheets P into the sheet bundle Q. The multiple sheet conveyance passages are space through which the sheet P and the sheet bundle Q are conveyed by the plurality of sheet conveyors. In addition, a plurality of sheet detection sensors are disposed to detect the position of the sheet P while the sheet P is conveyed in each sheet conveyance passage. Each sheet detection sensor is disposed at the predetermined position at which conveyance of the sheet P and the sheet bundle Q are controlled. Details of the control of conveyance of the sheet P and the sheet bundle Q are described below. Each sheet conveyor includes a conveyance roller pair. In other words, the sheet P and the sheet bundle Q are conveyed in a predetermined direction by each sheet conveying roller pair nipping the sheet P or the sheet bundle Q in the nip region. In addition, the sheet folding operation is performed depending on how the sheet P and the sheet bundle Q are conveyed to the nip region of each sheet conveying roller pair. As a result, the plurality of sheet conveyors also serve as sheet folders.

The sheet folder 200 includes seven sheet conveyance passages roughly. As illustrated in FIG. 4, the sheet folder 200 includes a first sheet conveyance passage W1, a second sheet conveyance passage W2, a third sheet conveyance passage W3, a fourth sheet conveyance passage W4, a fifth sheet conveyance passage W5, a sixth sheet conveyance passage W6, a seventh sheet conveyance passage W7.

Multiple roller pairs are disposed along the first sheet conveyance passage W1, the second sheet conveyance passage W2, the third sheet conveyance passage W3, the fourth sheet conveyance passage W4, the fifth sheet conveyance passage W5, the sixth sheet conveyance passage W6, and the seventh sheet conveyance passage W7. In other words, the plurality of sheet conveyance passages through which the sheet P is conveyed are provided with two rollers included in each of an entrance sheet conveyor R0, a first sheet conveyor R1, a second sheet conveyor R2, a third sheet conveyor R3, a fourth sheet conveyor R4, a fifth sheet conveyor R5, a sixth sheet conveyor R6, a seventh sheet conveyor R7, and an eighth sheet conveyor R8 disposed the predetermined positions. The start and end of rotations of each conveyance roller pair serving as a sheet conveyor are controlled by the control programs executed by the sheet folder controller 210. With this control, the start and end of conveyance of the sheet P are executed.

The sheet folder 200 includes a conveyance direction switcher that switches the direction of conveyance of the sheet P. With the conveyance direction switcher, the sheet folder 200 according to the present embodiment can execute multiple conveying operations on the sheet P that is held and conveyed from the upstream apparatus in the sheet conveyance direction and travels in the sheet folder 200. The conveying operation (performed in a conveyance mode) described below is an operation to switch the direction of conveyance of the sheet P along with the sheet receiving operation of the sheet P.

More specifically, the first sheet conveyance passage W1 is connected to an entrance 21 that receives a sheet from the image forming apparatus 100. The second sheet conveyance passage W2 is connected to the first sheet conveyance passage W1 at a connection point T1. In other words, one end of the second sheet conveyance passage W2 is connected to one end of the first sheet conveyance passage W1 at the connection point T1. The third sheet conveyance passage W3 is connected to the second sheet conveyance passage W2 at the other end from the connection point T1. In other words, one end of the third sheet conveyance passage W3 is connected to the other end of the second sheet conveyance passage W2 that is the other end from the connection point T1. The third sheet conveyance passage W3 is connected to the first sheet conveyance passage W1 at a connection point T2. In other words, the other end of the third sheet conveyance passage W3 is connected to the other end of the first sheet conveyance passage W1 at the connection point T2. The connection point T2 is located closer to the entrance 21 than the connection point T1 on the first sheet conveyance passage W1. In other words, the first sheet conveyance passage W1, the second sheet conveyance passage W2, and the third sheet conveyance passage W3 constitute a sheet circulation passage in which multiple sheets P conveyed in at predetermined time intervals are overlaid to form a sheet bundle Q.

The fourth sheet conveyance passage W4 is connected to the first sheet conveyance passage W1 at the connection point T1. In other words, one end of the fourth sheet conveyance passage W4 is connected to one end of the first sheet conveyance passage W1 at the connection point T1. In other words, the second sheet conveyance passage W2 and the fourth sheet conveyance passage W4 are branched from the first sheet conveyance passage W1 at the connection point T1. The fifth sheet conveyance passage W5 is connected to the second sheet conveyance passage W2 at the connection point T3. In other words, one end of the fifth sheet conveyance passage W5 is connected to one end of the second sheet conveyance passage W2 at the connection point T3. The connection point T3 on the second sheet conveyance passage W2 is located closer to the third sheet conveyance passage W3 than the connection point T1 on the second sheet conveyance passage W2. The fourth sheet conveyance passage W4 is connected to the fifth sheet conveyance passage W5 at a connection point T4 opposite to the connection point T1 and the connection point T3. In other words, the other end of the fourth sheet conveyance passage W4 opposite to the connection point T1 is connected to the other end of the fifth sheet conveyance passage W5 opposite to the connection point T3, at the connection point T4. In other words, the fourth sheet conveyance passage W4 and the fifth sheet conveyance passage W5 merge at the connection point T4.

The sixth sheet conveyance passage W6 and the seventh sheet conveyance passage W7 are connected to the fourth sheet conveyance passage W4 and the fifth sheet conveyance passage W5 at the connection point T4. In other words, one end of the sixth sheet conveyance passage W6 is connected to the other end of the fourth sheet conveyance passage W4 at the connection point T4, and one end of the seventh sheet conveyance passage W7 is connected to the other end of the fifth sheet conveyance passage W5 at the connection point T4. The sixth sheet conveyance passage W6 and the seventh sheet conveyance passage W7 extend from the connection point T4 in different directions from each other. In other words, the sixth sheet conveyance passage W6 and the seventh sheet conveyance passage W7 are branched off at the connection point T4.

The sheet conveyance direction of the first sheet conveyance passage W1 is a direction from the entrance 21 toward the connection point T1. The sheet conveyance direction of the second sheet conveyance passage W2 is a direction from the connection point T1 toward the third sheet conveyance passage W3 via the connection point T3. The sheet conveyance direction of the third sheet conveyance passage W3 is a direction from the second sheet conveyance passage W2 toward the connection point T2. The sheet conveyance direction of the fourth sheet conveyance passage W4 is a direction from the connection point T1 toward the connection point T4. The sheet conveyance direction of the fifth sheet conveyance passage W5 is a direction from the connection point T3 toward the connection point T4. The sheet conveyance direction of the sixth sheet conveyance passage W6 is a direction from the connection point T4 to the seventh sheet conveyor R7. The sheet conveyance direction of the seventh sheet conveyance passage W7 is a direction from the connection point T4 to the exit 22 of the sheet folder 200.

The entrance sheet conveyor R0 is disposed between the entrance 21 and the connection point T2. The first sheet conveyor R1 is disposed on the first sheet conveyance passage W1 between the connection point T1 and the connection point T2. The second sheet conveyor R2 is disposed between the second sheet conveyance passage W2 and the third sheet conveyance passage W3. The third sheet conveyor R3 is disposed on the third sheet conveyance passage W3 at the position closer to the connection point T2 than the second sheet conveyance passage W2. The fourth sheet conveyor R4 is disposed on the fourth sheet conveyance passage W4 between the connection point T1 and the connection point T4. The fifth sheet conveyor R5 is disposed on the fifth sheet conveyance passage W5 between the connection point T3 and the connection point T4. The sixth sheet conveyor R6 is disposed at the connection point T4. The seventh sheet conveyor R7 is disposed on the sixth sheet conveyance passage W6 downstream from the connection point T4 in the sheet conveyance direction. The eighth sheet conveyor R8 is disposed on the seventh sheet conveyance passage W7 between the connection point T4 and the exit 22.

The sheet folder 200 is provided with control functions that perform "ejection conveyance" as the conveyance for ejecting a sheet, "circulation conveyance" as the conveyance for circulating a sheet, and "folding conveyance" as the conveyance for folding sheets. Each of "ejection conveyance", "circulation conveyance", and "folding conveyance" is the conveying operation performed in the sheet folder 200 to convey, for example, the sheet P and is executed by the operation of each of the conveyance roller pairs and the operation of the conveyance direction switcher. In other words, the control operation of "ejection conveyance", the control operation of "circulation conveyance", and the control operation of "folding conveyance" are executed under the control of the sheet folder controller 210. Execution of each of the control operations may be switched based on the control command from the apparatus controller 110.

The ejection conveyance is to convey the sheet P that has already delivered and the sheet bundle Q in which a preceding sheet P that has been conveyed in the sheet folder 200 and a following sheet P that is newly conveyed to the sheet folder 200 are overlaid with each other are conveyed to a downstream part in the sheet conveyance direction to eject to the outside of the sheet folder 200. In other words, the "ejection conveyance" is a sheet conveying operation" in which first sheet conveyor R1 conveys the sheet P or the sheet bundle Q in the same direction as the sheet conveyance direction. In other words, the "ejection conveyance" is an operation to convey the sheet P or the sheet bundle Q from the first sheet conveyance passage W1 to the fourth sheet conveyance passage W4 that is downstream from the first sheet conveyance passage W1 in the sheet conveyance direction or from the first sheet conveyance passage W1 to the fifth sheet conveyance passage W5 via the second sheet conveyance passage W2. In other words, when the ejection conveyance is performed, the sheet P or the sheet bundle Q is conveyed from the first sheet conveyance passage W1 toward the exit 22 of the sheet folder 200 regardless of whether the sheet folding operation has not been performed on the sheet P or the sheet bundle Q or the sheet folding operation that is performed on the sheet P or the sheet bundle Q has been completed.

The circulation conveyance is a sheet conveying operation to circulate and convey the sheet P or the sheet bundle Q to the upstream side of the first sheet conveyor R1 (i.e., the first sheet conveyance passage W1) in the sheet conveyance direction without changing the leading end of the sheet P or the sheet bundle Q in the sheet conveyance direction when the sheet P or the sheet bundle Q is conveyed along the first sheet conveyance passage W1, in other words, without changing the leading end of the sheet P or the sheet bundle Q in the sheet conveyance direction when the sheet P or the sheet bundle Q is conveyed by the first sheet conveyor R1. In other words, the circulation conveyance is an operation to convey the sheet P or the sheet bundle Q from the first sheet conveyance passage W1 to the second sheet conveyance passage W2 that is downstream from the first sheet conveyance passage W1 in the sheet conveyance direction. In the "circulation conveyance", in order to return the sheet P conveyed to the second sheet conveyance passage W2 to the upstream side of the first sheet conveyance passage W1 in the sheet conveyance direction, the sheet P is conveyed from the second sheet conveyance passage W2 to the third sheet conveyance passage W3, then is circulated from the third sheet conveyance passage W3 to the first sheet conveyance passage W1. The conveyance passage in which the sheet P is circulated is referred to as a "sheet circulation passage". The "circulation conveyance" is performed when the number of sheets P in the sheet bundle Q has not reached the predetermined number of sheets. The circulation conveyance is performed until the number of sheets P in the sheet bundle Q reaches the maximum number of sheets for the sheet folding operation and the sheet folder controller 210 recognizes the control command of notification of the start of the sheet folding operation.

The "folding conveyance" is a sheet conveying operation to convey the predetermined folding position of the sheet P or the sheet bundle Q to the nip region of the first sheet folder F1. In other words, the "folding conveyance" corresponds to the conveyance in which the first sheet conveyor R1 changes the leading end of the sheet P or the sheet bundle Q in the sheet conveyance direction to convey the sheet P or the sheet bundle Q from the first sheet conveyance passage W1 to the second sheet conveyance passage W2 that is downstream from the first sheet conveyance passage W1 in the sheet conveyance direction. As a result, in the "folding conveyance", a portion of the sheet P or the sheet bundle Q, which is not the leading end of the sheet P or the sheet bundle Q when the sheet P or the sheet bundle Q passes the nip region of the first sheet conveyor R1, serves as the new leading end of the sheet P or the sheet bundle Q in the sheet conveyance direction to convey the sheet P or the sheet bundle Q to the second sheet conveyance passage W2. By so doing, the new leading end of the sheet P or the sheet bundle Q in the sheet conveyance direction passes the nip region of the first sheet folder F1 to form the fold. In other words, the new leading end of the sheet P or the sheet bundle Q in the sheet conveyance direction (i.e., the leading end of the sheet P or the sheet bundle Q conveyed into the second sheet conveyance passage W2) is folded as the fold of the sheet P or the sheet bundle Q. When the second fold is formed, a portion of the sheet P or the sheet bundle Q that is different from the leading end of the sheet P or the sheet bundle Q in the sheet conveyance direction serves as a new leading end of the sheet P or the sheet bundle Q in the sheet conveyance direction to be conveyed to yet another sheet conveyance passage. In the present embodiment, the sheet P or the sheet bundle Q is conveyed to the fifth sheet conveyance passage W5 to form the second fold. As described above, the "folding conveyance" is the conveyance to form a fold on the sheet P or the sheet bundle Q.

The conveyance direction switcher may switch the conveyance direction such that the sheet P or the sheet bundle Q is conveyed from the first sheet conveyance passage W1 to the fifth sheet conveyance passage W5 via the second sheet conveyance passage W2 and the third sheet conveyance passage W3. The conveyance control in this case is also included in the "folding conveyance". As described above, the sheet folder 200 includes multiple sheet conveyance passages so as to switch between the conveyance in which the leading end of the sheet P or the sheet bundle Q in the sheet conveyance direction is changed and the conveyance in which the leading end of the sheet P or the sheet bundle Q in the sheet conveyance direction is not changed. The sheet folder 200 includes multiple conveyance direction switchers to perform switching of the multiple sheet conveyance passages.

Description of Conveyance Direction Switchers

Figure 5:
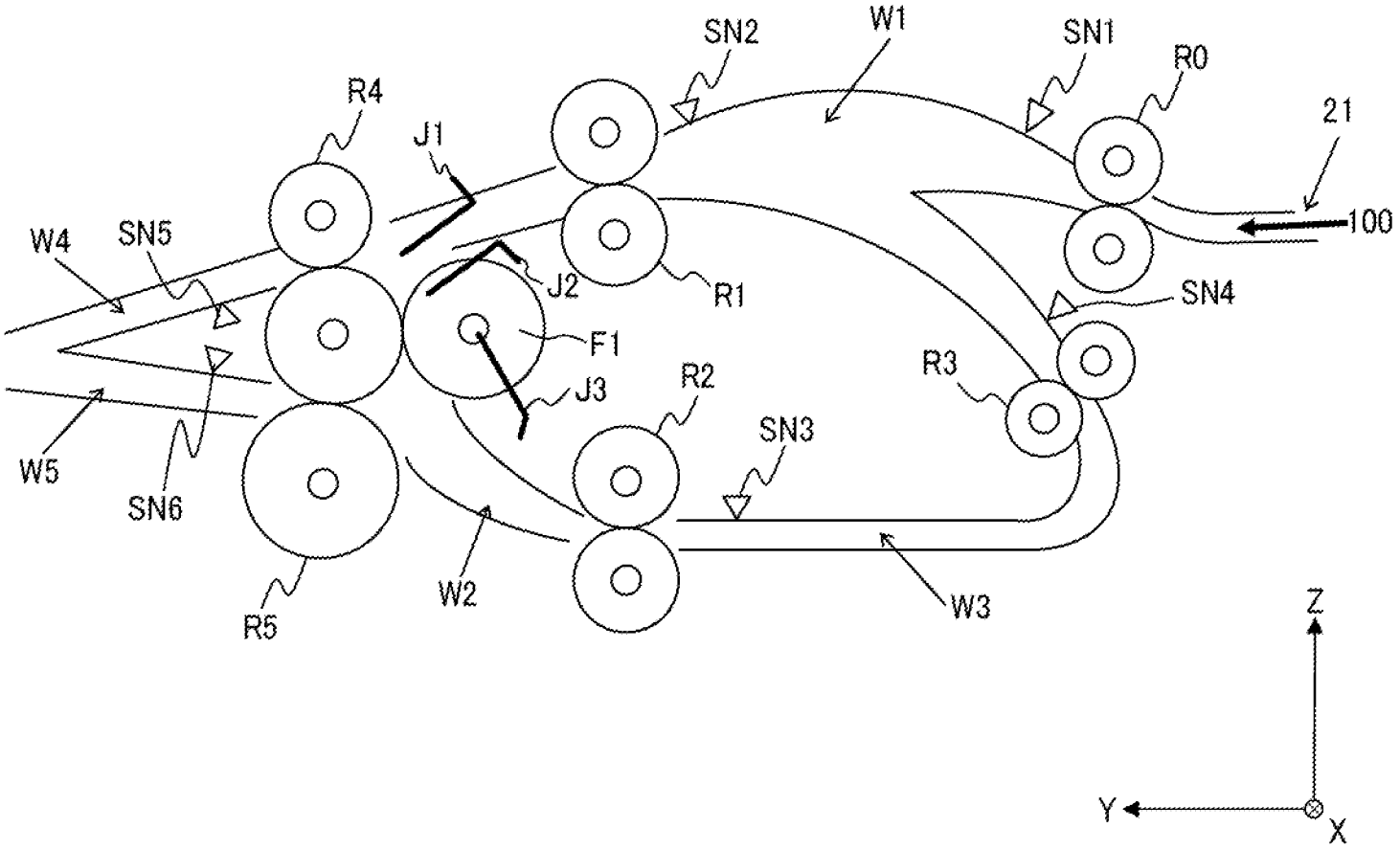
FIG. 5 is an enlarged view of the internal configuration of the sheet folder, illustrating a process of a folding conveyance in the sheet folder.

Each of the multiple conveyance direction switchers includes, for example, a combination of the first sheet conveyor R1, the fourth sheet conveyor R4, the first sheet folder F1, and the fifth sheet conveyor R5. For example, as illustrated in FIG. 5, the multiple conveyance direction switchers include a first switching member J1, a second switching member J2, and a third switching member J3. The multiple conveyance direction switchers are included in the various components 220 whose operations are controlled by the sheet folder controller 210. As a result, the sheet folder controller 210 controls the operations of the multiple conveyance direction switchers to control the operations of the multiple sheet conveyors that convey the sheet P and the sheet bundle Q to selectively switch the multiple sheet conveyance passages. Additionally, the sheet folder 200 includes the first sheet folder F1 and a second sheet folder F2 in the sheet circulation passage to perform the sheet folding operation on the sheet P and the sheet bundle Q.

As will be described below, before the sheet folder 200 ejects the sheet P delivered from the image forming apparatus 100 to the exit 22 (see FIG. 4) at the downstream side in the sheet conveyance direction, the sheet folder 200 receives the following sheet P and performs the circulation conveyance as a sheet conveying operation on the sheet bundle Q including the preceding sheet P and the following sheet P overlaid with each other or the folding conveyance to perform the predetermined sheet folding operation on the sheet P and the sheet bundle Q.

In the following description, the sheet P conveyed from the image forming apparatus 100 to the sheet folder 200 (i.e., the sheet P that is conveyed in the preceding manner) is referred to as a "preceding sheet P1". The sheet P to be conveyed to the sheet folder 200 following the preceding sheet P1 to be overlaid with the preceding sheet P1 is referred to as a "following sheet P2". The sheet P to be conveyed to the sheet folder 200 following the following sheet P2 to be overlaid with the preceding sheet P1 and the following sheet P2 is referred to as a "second following sheet P3". In addition, multiple sheets P overlaid with each other is referred to as a "sheet bundle Q" as described above.

The sheet folder 200 has the predetermined upper limit to the number of sheets P when the sheet overlaying operation or the sheet folding operation is performed on the sheets P. This upper limit is referred to as a "maximum number". In the following description, the maximum number of sheets is three. However, the maximum number of sheets in the sheet folder 200 according to the present embodiment is not limited to three and may be two or more.

Description of Sheet Conveyors

The sheet folder 200 includes an entrance sheet conveyor R0 serving as an entrance conveyance roller pair proximate to an entrance 21 at which the sheet from the image forming apparatus 100 is received. In response to reception of information that the preceding sheet P1 is ejected from the image forming apparatus 100, the sheet folder controller 210 controls a drive motor that rotates the entrance sheet conveyor R0 to start rotations of the entrance sheet conveyor R0. Then, when the leading end of the preceding sheet P1 reaches the nip region formed by the pair of rollers of the entrance sheet conveyor R0, the entrance sheet conveyor R0 conveys the preceding sheet P1 toward the downstream side in the sheet conveyance direction.

The first sheet conveyor R1 is disposed in the first sheet conveyance passage W1 that is downstream from the entrance sheet conveyor R0 in the sheet conveyance direction and includes a pair of rollers that forms a nip region at which the preceding sheet P1 conveyed from the upstream side is nipped so as to convey the preceding sheet P1 toward the downstream side in the sheet conveyance direction.

The first sheet conveyor R1 also serves as a skew corrector that causes the leading end of the preceding sheet P1 conveyed from the upstream side to contact the nip region so as to correct the inclination of the posture of the preceding sheet P1 in the sheet conveyance direction. The first sheet conveyor R1 performs skew correction for correcting displacement of the conveyance posture of the sheet P (i.e., the preceding sheet P1) to be conveyed from the entrance sheet conveyor R0 to the first sheet conveyor R1.

When the skew correction is performed, the conveyance roller pair (i.e., the sheet conveyor) is controlled to temporarily stop the rotation performed as a sheet conveying operation or to rotate the conveyance roller pair in reverse, which is a rotational operation opposite to the normal sheet conveying operation.

If the conveyance roller pair included in the first sheet conveyor R1 is reversely rotated during the skew correction, the reverse rotation of the conveyance roller pair is stopped when the preceding sheet P1 contacts the nip region. Then, as the rotation of the conveyance roller pair in the forward direction is started at the predetermined timing to convey the preceding sheet P1, the preceding sheet P1 is conveyed to a further downstream side in the sheet conveyance direction.

The first sheet folder F1 is disposed on the second sheet conveyance passage W2 between the connection point T1 and the connection point T3. The first sheet folder F1 is a pair of rollers facing each other on the second sheet conveyance passage W2. The pair of rollers of the first sheet folder F1 forms a nip region. Then, the preceding sheet P1 that is guided by the nip region of the first sheet folder F1 passes through the sheet conveyance passage, then is guided from the first sheet conveyance passage W1 to the second sheet conveyance passage W2. When the preceding sheet P1 passes the first sheet folder F1, the leading end of the preceding sheet P1 in the sheet conveyance direction is not changed at the first sheet conveyor R1. This conveyance control corresponds to the "circulation conveyance". Alternatively, when the preceding sheet P1 is guided by the nip region of the first sheet folder F1 and passes through the sheet conveyance passage, the leading end of the preceding sheet P1 in the sheet conveyance direction is different from the leading end of the preceding sheet P1 when the sheet is conveyed in the sheet conveyance direction by the first sheet conveyor R1. This conveyance control corresponds to the "folding conveyance". The sheet folder 200 switches, based on the operations of the multiple sheet conveyance roller pairs, whether the leading end of the preceding sheet P1 in the sheet conveyance direction when passing the first sheet folder F1 is the same as the leading end of the preceding sheet P1 when passing the nip region of the first sheet conveyor R1 or is different from the leading end of the preceding sheet P1 when passing the nip region of the first sheet conveyor R1.

Further, the preceding sheet P1 guided to the second sheet conveyance passage W2 is conveyed to the third sheet conveyance passage W3 by the third sheet conveyor R3 for circulation conveyance. Subsequently, the third conveyor R3 temporarily stops the conveyance of the preceding sheet P1 in the third sheet conveyance passage W3.

The conveyance of the preceding sheet P1 that is temporarily stopped in the third sheet conveyance passage W3 is resumed when the sheet folder 200 receives the following sheet P2 from the image forming apparatus 100. As a result, the preceding sheet P1 returns to a portion upstream from the first sheet conveyor R1 in the first sheet conveyance passage W1 and meets the following sheet P2 to be overlaid with each other at the predetermined position in the first sheet conveyance passage W1. As described above, the circulation conveyance passage is formed.

In the circulation conveyance passage described above, the preceding sheet P1 and the following sheet P2 are overlaid with each other to form the sheet bundle Q. A description is now given of the flow for performing the sheet folding operation (the overlaying operation) on the sheet bundle Q, with reference to FIGS. 4 and 5.

FIG. 5 is an enlarged view of the internal configuration of the sheet folder 200 in a process of the sheet folding operation (the sheet overlaying operation) in the sheet folding conveyance in the sheet folder 200.

The sheet folding operation on the sheet bundle Q is typically performed by the first sheet folder F1 that is operated under the control of the sheet folder controller 210 after the sheet folder controller 210 receives the "sheet overlaying operation start instruction" that is sent by the apparatus controller 110. The sheet bundle Q subjected to the sheet folding operation (the sheet overlaying operation) by the first sheet folder F1 is delivered from the second sheet conveyance passage W2 to the fifth sheet conveyance passage W5 to be ejected. The fourth sheet conveyor R4, the fifth sheet conveyor R5, and the first sheet folder F1 share the same drive motor. The drive motor can rotate in the forward direction and the reverse direction that is opposite to the forward direction. Changing the direction of rotation of the drive motor switches the sheet conveying operations between the circulation conveyance on the sheet bundle Q including the preceding sheet P1 and the following sheet P2 overlaid with each other or the folding conveyance including the sheet folding operation on the sheet bundle Q.

A switching member 23 having, for example, a claw shape is disposed downstream from the sixth sheet conveyor R6 in the sheet conveyance direction. The switching member 23 appropriately switches the direction of conveyance of the sheet P (the sheet bundle Q) between the case where the sheet P (the sheet bundle Q) is guided toward the sixth sheet conveyance passage W6 and the case where the sheet P (the sheet bundle Q) is guided toward the seventh sheet conveyance passage W7. The switching of the direction of conveyance of the sheet P (the sheet bundle Q) is achieved by changing the position of the switching member 23. The position of the switching member 23 may be switched by, for example, a solenoid. The solenoid may be replaced by a driving mechanism including, for example, a motor, a gear, and a cam.

The sheet P having passed through the fourth sheet conveyance passage W4 or the fifth sheet conveyance passage W5 is ejected to and stacked on an ejection tray 24 of the sheet folder 200. The seventh sheet conveyance passage W7 is used to deliver the sheet P to a post-processing apparatus when the post-processing apparatus is disposed downstream from the sheet folder 200 that is included in an image forming system. The post-processing apparatus performs the post-processing operations including, for example, an alignment operation or a binding operation on the folded sheet P on which the sheet folding operation has been performed or the non-folded sheet P that is not subject to the sheet folding operation.

A first sheet detection sensor SN1 is disposed downstream from the entrance sheet conveyor R0 in the sheet conveyance direction in the first sheet conveyance passage W1.

A second sheet detection sensor SN2 is disposed upstream from the first sheet conveyor R1 in the sheet conveyance direction in the first sheet conveyance passage W1. The second sheet detection sensor SN2 is disposed downstream from the first sheet detection sensor SN1 in the sheet conveyance direction in the first sheet conveyance passage W1.

A third sheet detection sensor SN3 is disposed downstream from the second sheet conveyor R2 in the sheet conveyance direction (when the circulation conveyance is performed) in the third sheet conveyance passage W3 that is included in the sheet circulation passage.

A fourth sheet detection sensor SN4 is disposed downstream from the third sheet conveyor R3 in the sheet conveyance direction (when the circulation conveyance is performed) in the third sheet conveyance passage W3.

A fifth sheet detection sensor SN5 is disposed downstream from the fourth sheet conveyor R4 in the sheet conveyance direction (when the ejection conveyance is performed) in the fourth sheet conveyance passage W4 that is included in the conveyance passage of the sheet P in the ejection conveyance.

A sixth sheet detection sensor SN6 is disposed downstream from the fifth sheet conveyor R5 in the sheet conveyance direction (when the ejection conveyance is performed) in the fifth sheet conveyance passage W5.

A seventh sheet detection sensor SN7 is disposed downstream from the sixth sheet conveyor R6 in the sheet conveyance direction (when the ejection conveyance is performed) in the sixth sheet conveyance passage W6.

Further, an eighth sheet detection sensor SN8 is disposed downstream from the eighth sheet conveyor R8 in the sheet conveyance direction (when the ejection conveyance is performed) in the seventh sheet conveyance passage W7.

Example of Sheet Overlaying Operation

The sheet folder 200 described above can perform a letter fold-in and a letter fold-out on the overlaid sheets P (the sheet bundle Q).

A description is given of a series of operations in which two sheets P are overlaid with each other to form the sheet bundle Q via the sheet circulation passage.

Figure 6:
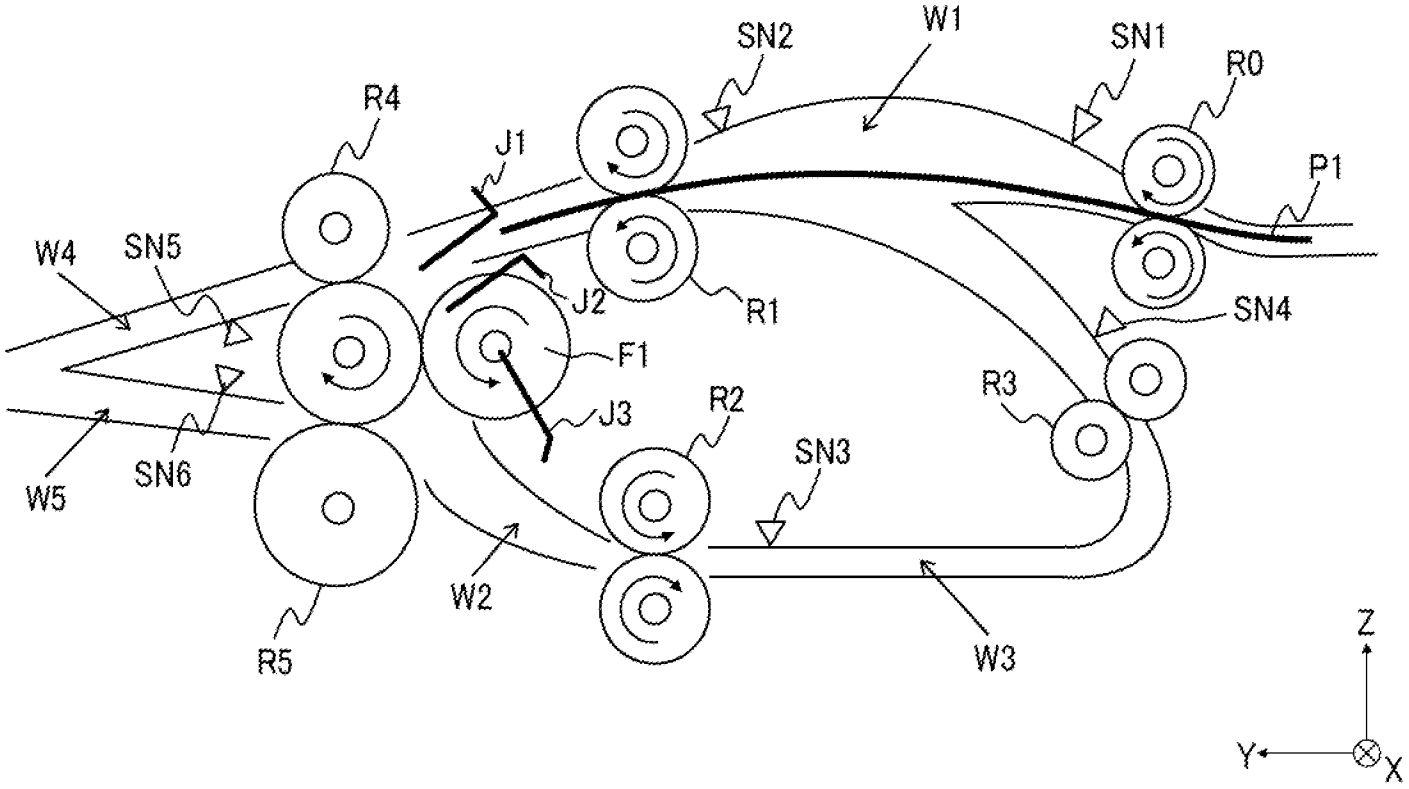
FIG. 6 is an enlarged view of the internal configuration of the sheet folder, illustrating the subsequent process of the folding conveyance in the sheet folder of FIG. 5.

FIG. 6 is an enlarged view of the internal configuration of the sheet folder 200, illustrating the subsequent process of the folding conveyance in the sheet folder 200 of FIG. 5.

Figure 7:
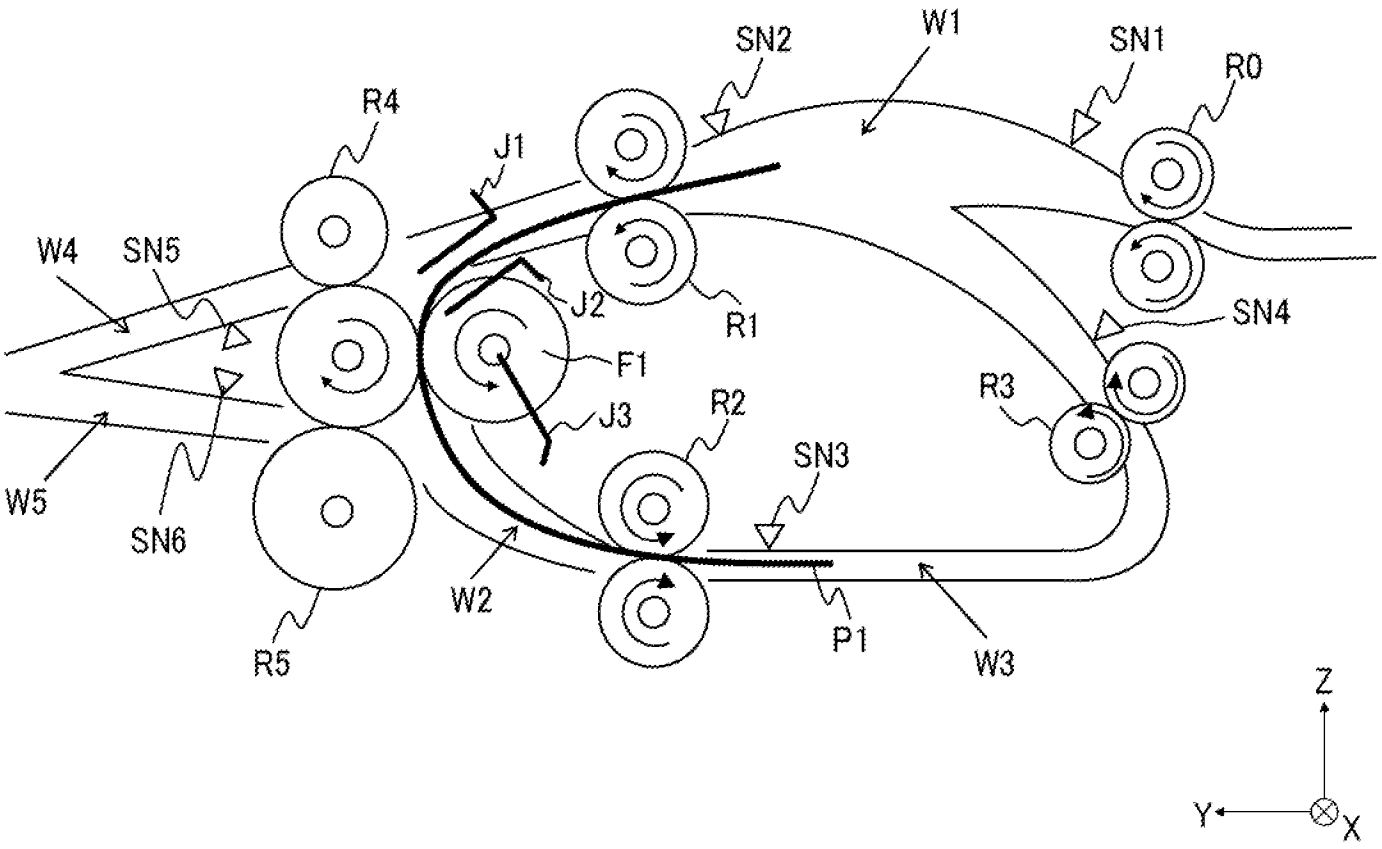
FIG. 7 is an enlarged view of the internal configuration of the sheet folder, illustrating the subsequent process of the folding conveyance in the sheet folder of FIG. 6.

FIG. 7 is an enlarged view of the internal configuration of the sheet folder 200, illustrating the subsequent process of the folding conveyance in the sheet folder 200 of FIG. 6.

Figure 8:
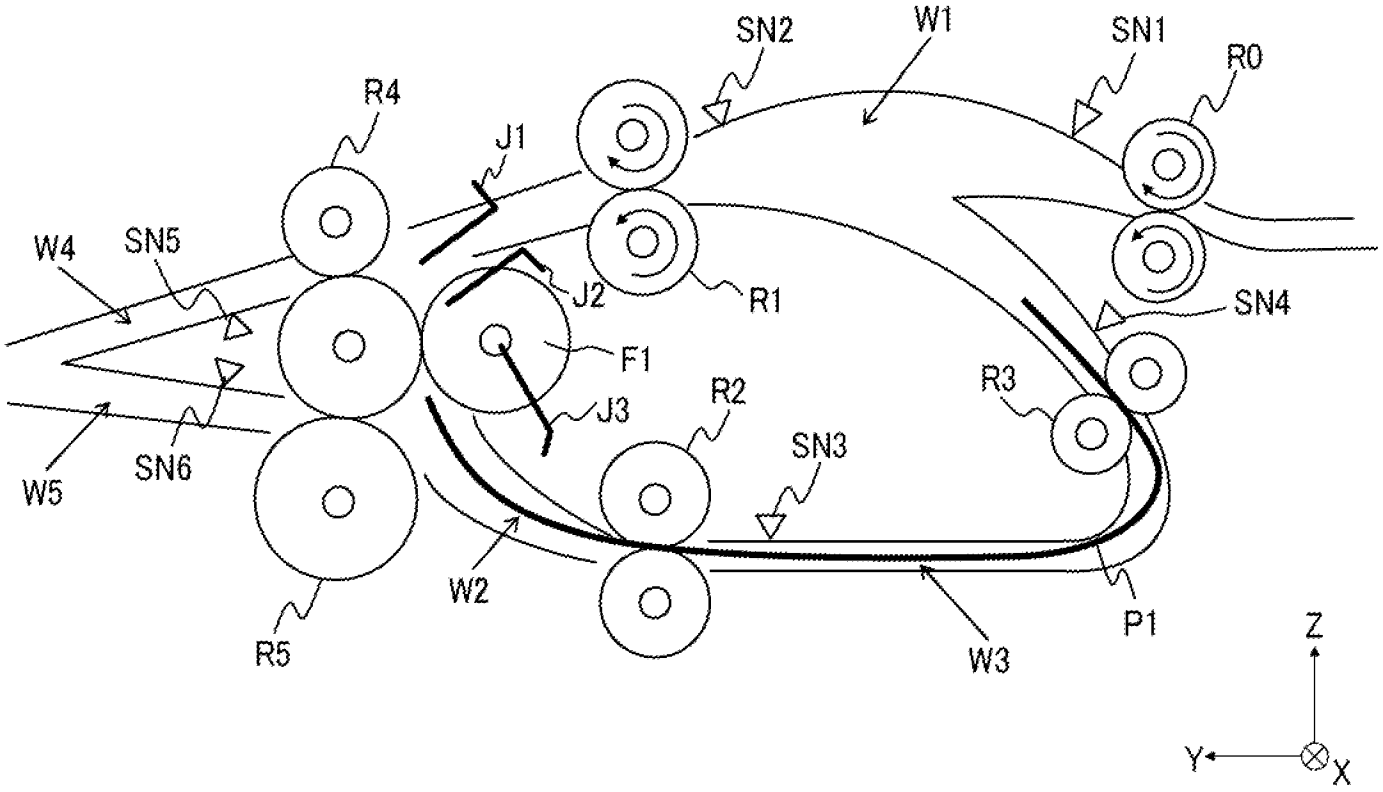
FIG. 8 is an enlarged view of the internal configuration of the sheet folder, illustrating the subsequent process of the folding conveyance in the sheet folder of FIG. 7.

FIG. 8 is an enlarged view of the internal configuration of the sheet folder 200, illustrating the subsequent process of the folding conveyance in the sheet folder 200 of FIG. 7.

Figure 9:
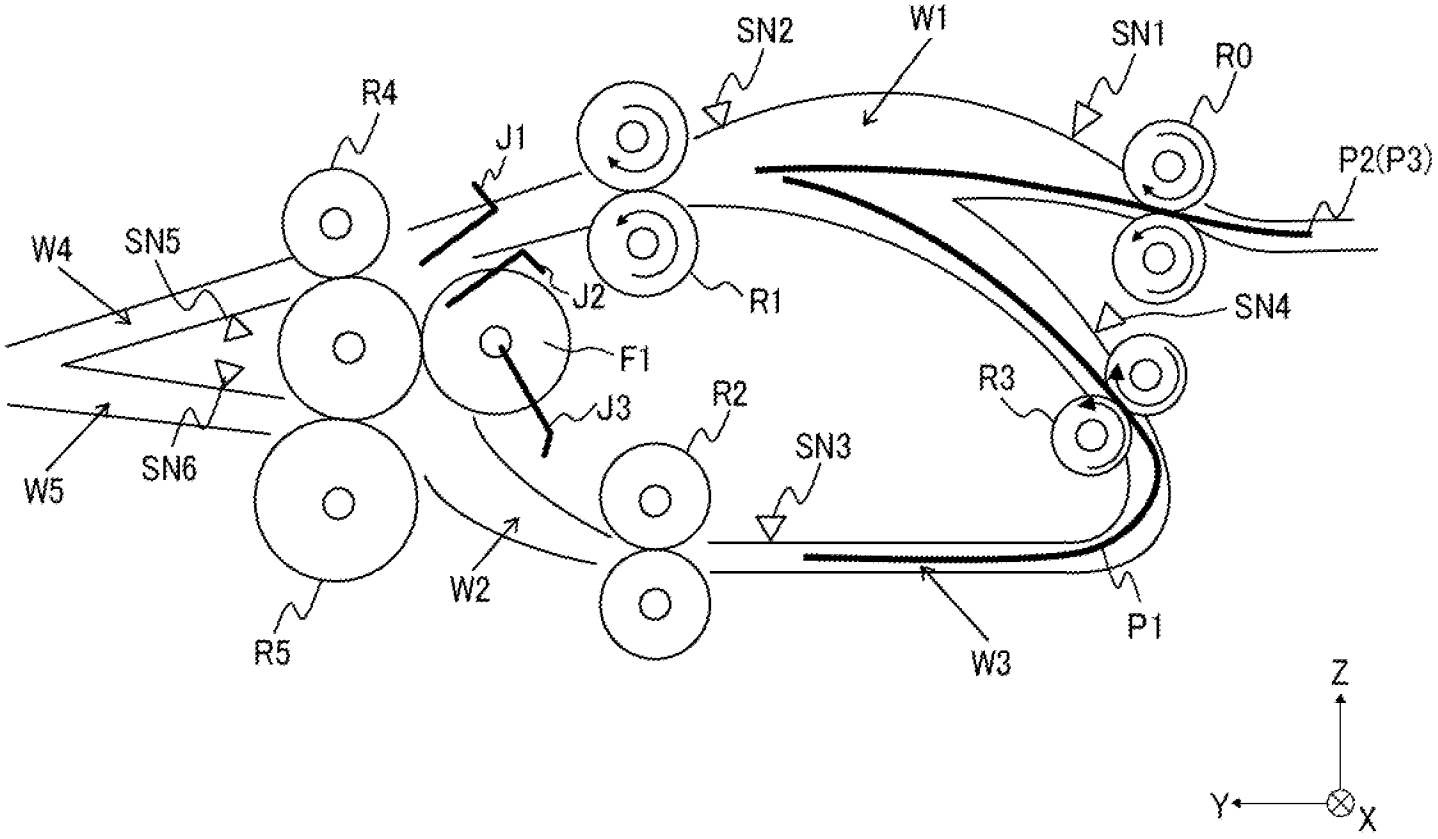
FIG. 9 is an enlarged view of the internal configuration of the sheet folder, illustrating the subsequent process of the folding conveyance in the sheet folder of FIG. 8.

FIG. 9 is an enlarged view of the internal configuration of the sheet folder 200, illustrating the subsequent process of the folding conveyance in the sheet folder 200 of FIG. 8.

Figure 10:
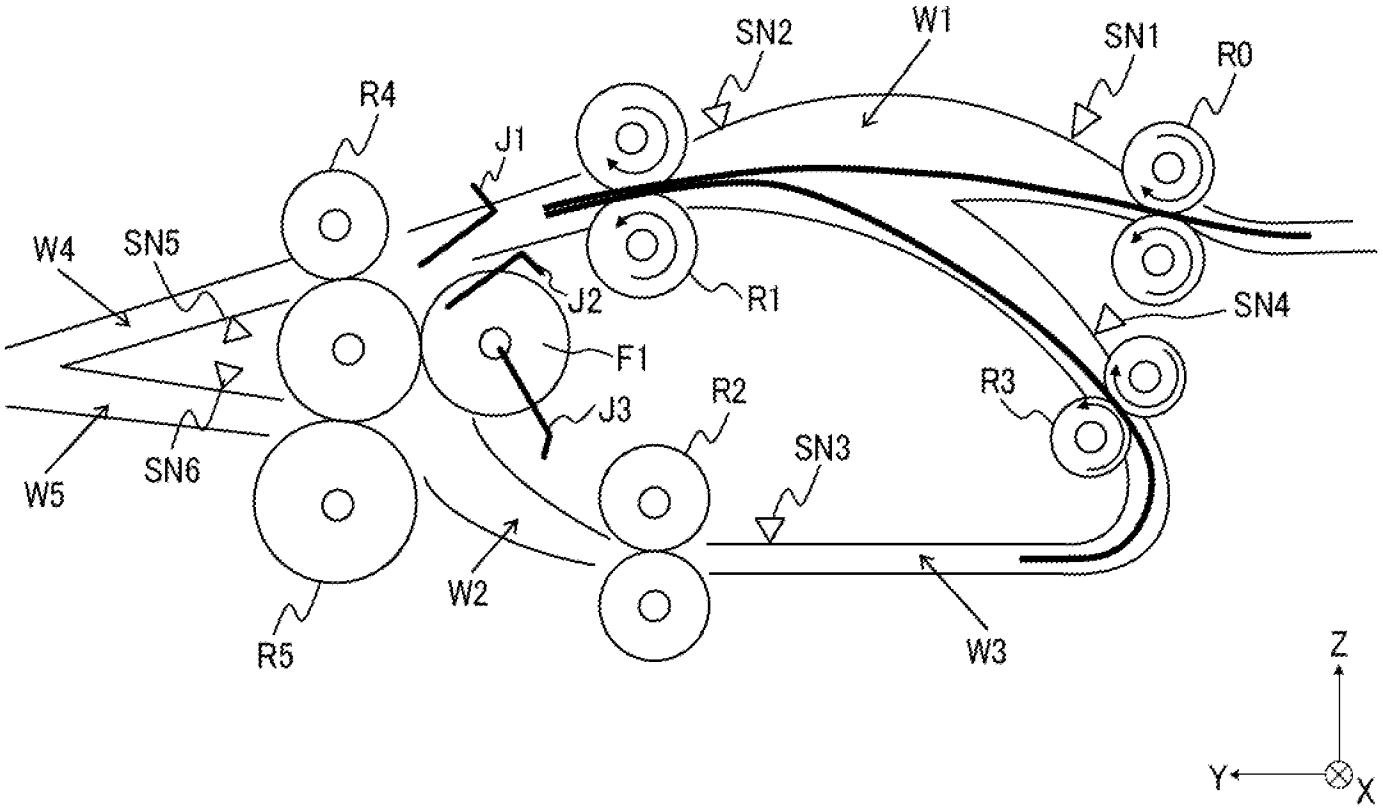
FIG. 10 is an enlarged view of the internal configuration of the sheet folder, illustrating the subsequent process of the folding conveyance in the sheet folder of FIG. 9.

FIG. 10 is an enlarged view of the internal configuration of the sheet folder 200, illustrating the subsequent process of the folding conveyance in the sheet folder 200 of FIG. 9.

FIG. 5 illustrates the initial state of the sheet folder 200 before the sheet P is conveyed from the image forming apparatus 100. In the initial state of the sheet folder 200 in FIG. 5, the entrance sheet conveyor R0 starts rotating under the control of the sheet folder controller 210 when the leading end of the preceding sheet P1 that is conveyed from the image forming apparatus 100 reaches the ejection port of the image forming apparatus 100.

As illustrated in FIG. 6, the rotation of the entrance sheet conveyor R0 conveys the preceding sheet P1 to the first sheet conveyance passage W1. The sheet folder controller 210 moves the first switching member J1 to the position illustrated in FIG. 6 not to perform the "ejection conveyance" that guides the preceding sheet P1 to the fourth sheet conveyance passage W4 but to perform the "circulation conveyance" that conveys the preceding sheet P1 to the second sheet conveyance passage W2 and guides the preceding sheet P1 to the sheet circulation passage.

Then, when the leading end of the preceding sheet P1 conveyed by the entrance sheet conveyor R0 is detected by the first sheet detection sensor SN1 that is disposed upstream from the first sheet conveyor R1 in the sheet conveyance direction, the detection signal of the leading end of the preceding sheet P1 is sent to the sheet folder controller 210. After the sheet folder controller 210 receives the detection signal of the leading end of the sheet P (i.e., the preceding sheet P1), the sheet folder controller 210 calculates the timing at which the amount of projection (i.e., the projection amount) reaches the predetermined amount, where the amount of projection (the projection amount) is an amount in which the position of the leading end of the sheet P projects from the nip position of the first sheet conveyor R1 after the receipt of the detection signal of the sheet P. The projection amount of the leading end of the sheet P from the nip position of the first sheet conveyor R1 is referred to as a "first contact amount Δ1". The sheet folder controller 210 causes the first sheet conveyor R1 to start the rotation at the timing that the projection amount of the leading end of the sheet Preaches the first contact amount Δ1.

At the timing at which the leading end of the preceding sheet P1 enters the nip region of the first sheet conveyor R1, the sheet folder controller 210 rotates the first sheet folder F1, the second sheet conveyor R2, and the third sheet conveyor R3.

By so doing, as illustrated in FIG. 7, the preceding sheet P1 is conveyed to the second sheet conveyance passage W2 by the rotations of the first sheet conveyor R1 and the rotations of the first sheet folder F1, then is conveyed to the second sheet conveyor R2 along the downward slope of the second sheet conveyance passage W2. The rotations of the second sheet conveyor R2 convey the preceding sheet P1 to the third sheet conveyance passage W3. The preceding sheet P1 conveyed to the third sheet conveyance passage W3 is further conveyed to the downstream side in the sheet conveyance direction by the third sheet conveyor R3. When the fourth sheet detection sensor SN4 detects the leading end of the preceding sheet P1 conveyed by the third sheet conveyor R3, the detection signal is sent from the fourth sheet detection sensor SN4 to the sheet folder controller 210. In response to the detection signal from the fourth sheet detection sensor SN4, the sheet folder controller 210 calculates the time at which the third sheet conveyor R3 conveys the leading end of the preceding sheet P1 from the position of the fourth sheet detection sensor SN4 to the position corresponding to the second projection amount Δ2.

In other words, placing the first switching member J1 at the position as illustrated in FIG. 6 allows the preceding sheet P1 to be conveyed to the downstream side in the sheet conveyance direction without changing the leading end of the preceding sheet P1 in the sheet conveyance direction when the preceding sheet P1 passes the first sheet conveyor R1. With this conveyance control, the circulation conveyance of the preceding sheet P1 is performed.

As illustrated in FIG. 8, when sheet folder controller 210 determines that the leading end of the preceding sheet P1 reaches the position corresponding to the second projection amount Δ2, the sheet folder controller 210 causes the first sheet folder F1, the second sheet conveyor R2, and the third sheet conveyor R3 to stop rotating to temporarily stop the circulation conveyance of the preceding sheet P1.

Even when the conveyance of the preceding sheet P1 is stopped, the first sheet conveyor R1 continues the rotations to accept the following sheet P2 that is subsequently conveyed from the image forming apparatus 100.

After the detection signal indicating that the leading end of the following sheet P2 is detected by the first sheet detection sensor SN1 is sent to the sheet folder controller 210, as illustrated in FIG. 9, the sheet folder controller 210 continues the conveyance of the following sheet P2 and resumes the conveyance of the preceding sheet P1 at the predetermined time calculated based on the detection timing of the first sheet detection sensor SN1.

As a result, the following sheet P2 and the preceding sheet P1 are overlaid with each other at the predetermined position (i.e., the overlaying position) in the first sheet conveyance passage W1. When the following sheet P2 and the preceding sheet P1 are overlaid with each other, the leading end of the following sheet P2 is placed slightly downstream from the leading end of the preceding sheet P1 in the sheet conveyance direction.

The sheet bundle Q in which the following sheet P2 and the preceding sheet P1 are overlaid with each other is conveyed to the nip region of the first sheet conveyor R1. This timing at which the sheet bundle Q is conveyed to the nip region of the first sheet conveyor R1 corresponds to the timing at which the following sheet P2 reaches the position corresponding to the third projection amount Δ3 when the leading end of the following sheet P2 meets the preceding sheet P1. In other words, when the leading end of the following sheet P2 reaches the position corresponding to the third projection amount Δ3, the sheet folder controller 210 causes the second sheet conveyor R2 and the third sheet conveyor R3 to resume the rotations. As a result, as illustrated in FIG. 9, the conveyance of the preceding sheet P1 that has been stopped is resumed.

In this case, the sheet folder controller 210 calculates the timing at which the conveyance of the preceding sheet P1 is resumed, based on the detection by the first sheet detection sensor SN1, without stopping the conveyance of the following sheet P2. When the timing at which the conveyance of the preceding sheet P1 is resumed comes, the sheet folder controller 210 resumes the conveyance of the preceding sheet P1. With this control, the following sheet P2 and the preceding sheet P1 are conveyed in a manner being overlaid with each other.

When the following sheet P2 and the preceding sheet P1 are conveyed in a manner being overlaid with each other, the leading end of the following sheet P2 is placed slightly downstream from the leading end of the preceding sheet P1 in the sheet conveyance direction toward the first sheet conveyor R1.

The sheet folder controller 210 calculates the third projection amount Δ3 based on the speed of motor (motor speed) that drives the entrance sheet conveyor R0, the speed of motor (motor speed) that drives the third sheet conveyor R3, and the relative positions (relative distances) of the first sheet detection sensor SN1, the second sheet detection sensor SN2, and the fourth sheet detection sensor SN4. The third projection amount Δ3 corresponds to the amount in which the leading end of the following sheet P2 is placed downstream from the leading end of the preceding sheet P1 in the sheet conveyance direction (preceding amount) when the leading end of the preceding sheet P1 and the leading end of the following sheet P2 meet each other at a position upstream from the first sheet conveyor R1 in the sheet conveyance direction.

Then, the leading end of the preceding sheet P1 and the leading end of the following sheet P2 meet each other to form the sheet bundle Q. The sheet bundle Q passes through the nip region of the first sheet conveyor R1 to be conveyed to the downstream side in the sheet conveyance direction, as illustrated in FIG. 10. As described above, the sheet folder controller 210 controls such that the following sheet P2 contacts the nip region of the first sheet conveyor R1 before the preceding sheet P1 contacts the nip region of the first sheet conveyor R1. As a result, when the third projection amount Δ3 is relatively large in a state where the preceding sheet P1 and the following sheet P2 have not met each other at a position upstream from the second sheet detection sensor SN2 in the sheet conveyance direction, the timing at which the preceding sheet P1 and the following sheet P2 meet each other can be adjusted.

Then, the sheet folder controller 210 determines whether the set number of sheets to be folded that has been sent from the image forming apparatus 100 matches the number of sheets accepted by the sheet folder 200. When the set number of sheets sent from the image forming apparatus 100 matches the number of sheet accepted by the sheet folder 200, the sheet folding operation described below is performed. By contrast, when the set number of sheets sent from the image forming apparatus 100 does not match the number of sheet accepted by the sheet folder 200, the operations illustrated in FIGS. 7 to 9 are repeated to cause the second following sheet P3 conveyed from the image forming apparatus 100 (i.e., the sheet P after the following sheet P2) to meet the sheet bundle Q so that the second following sheet P3 is overlaid with the sheet bundle Q. Whether the sheet P is conveyed to the position immediately before the nip region of the second sheet conveyor R2 can be determined based on, for example, the number of driving steps of the motor that drives the first sheet conveyor R1. Accordingly, a stepper motor is preferably used as the drive motor to drive and rotate each sheet conveyer. If the drive motor is controlled based on the timing calculated in response to the detection of each sensor, a direct-current motor (DC motor) may be used as the drive motor to drive and rotate each sheet conveyor.

Embodiment of Sheet Folding Operation

A description is now given of the flow of the sheet folding operation in the sheet folder 200 according to the present embodiment.

FIGS. 11, 12, 13, and 14 are enlarged views of the internal configuration of the sheet folder 200 in the subsequent processes of the folding conveyance in which the sheet bundle Q received from the upstream side in the sheet conveyance direction to form the letter fold-out on the sheet bundle Q.

As described with reference to FIG. 10, the sheet bundle Q including the preceding sheet P1 and the following sheet P2 met with each other is continuously conveyed by the entrance sheet conveyor R0 and the first sheet conveyor R1. When the leading end of the sheet bundle Q enters the nip region of the first sheet conveyor R1, the sheet bundle Q is conveyed toward the fourth sheet conveyor R4.

Figure 11:
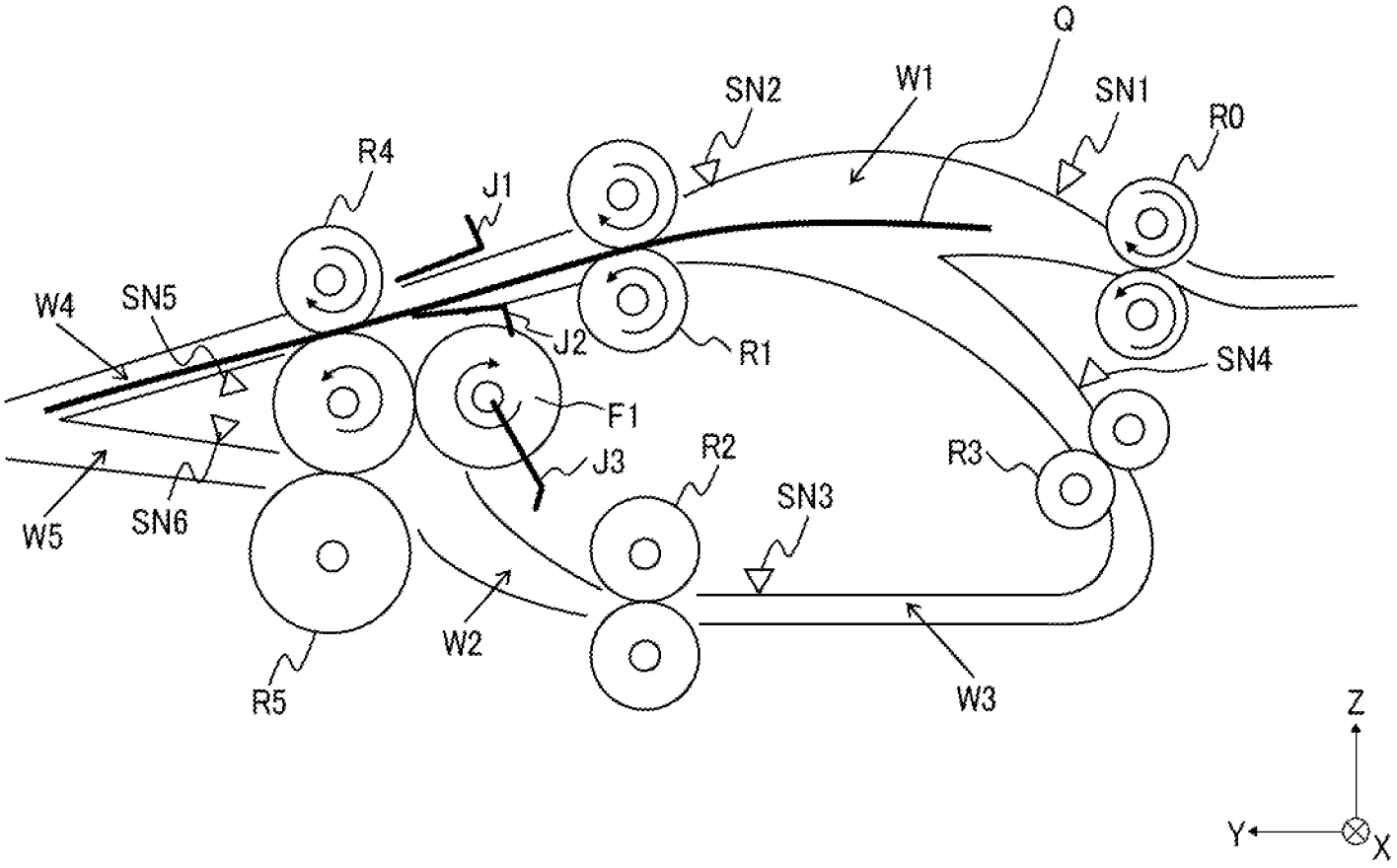
FIG. 11 is an enlarged view of the internal configuration of the sheet folder, illustrating the subsequent process of the folding conveyance in the sheet folder of FIG. 10.
Figure 12:
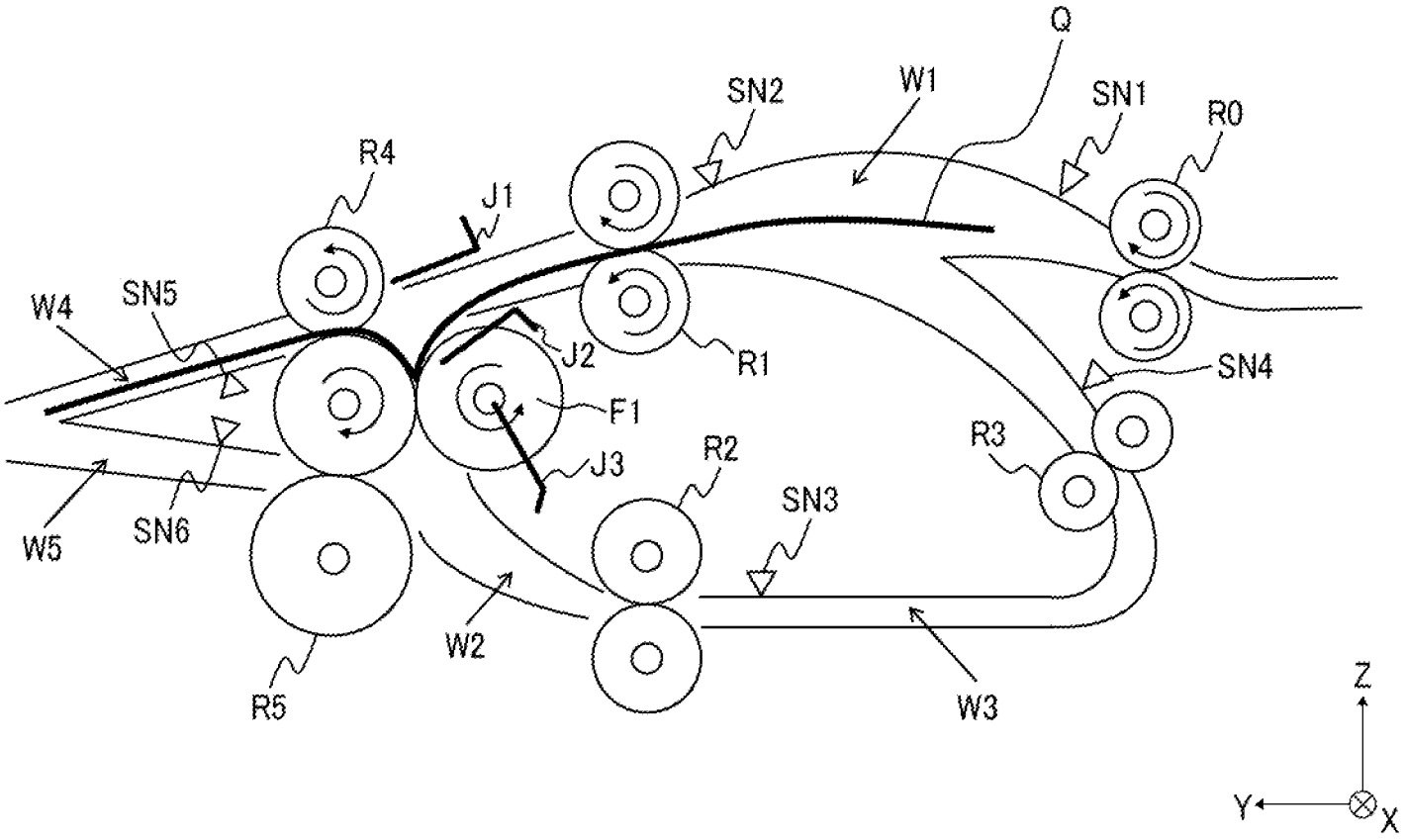
FIG. 12 is an enlarged view of the internal configuration of the sheet folder, illustrating the subsequent process of the folding conveyance in the sheet folder of FIG. 11.

The sheet folder controller 210 starts driving the motor when the sheet bundle Q is conveyed to the position immediately before the nip region of the fourth sheet conveyor R4 so as to rotate the first sheet conveyor R1 and the fourth sheet conveyor R4 in the direction indicated by the arc-shaped arrows in FIG. 11. The sheet folder controller 210 determines the position of the leading end of the sheet bundle Q based on the elapsed time from when the leading end of the sheet bundle Q is detected by the fifth sheet detection sensor SN5. The sheet folder controller 210 causes the first sheet conveyor R1 and the fourth sheet conveyor R4 to further convey the sheet bundle Q. By so doing, the first sheet conveyor R1 and the fourth sheet conveyor R4 continue the conveyance of the sheet bundle Q until the leading end of the sheet bundle Q reaches a fourth projection amount Δ4 that is the predetermined projection amount from the fifth sheet detection sensor SN5.

When the sheet folder controller 210 determines that the leading end of the sheet bundle Q has reached the fourth projection amount Δ4, the sheet folder controller 210 causes the first sheet conveyor R1 to rotate in the same rotational direction to maintain the state where the sheet bundle Q is conveyed in the sheet conveyance direction. On the other hand, the sheet folder controller 210 causes the fourth sheet conveyor R4 to rotate in the reverse direction and the first sheet folder F1 to rotate in the reverse direction that is the other direction to the rotational direction of the first sheet folder F1 illustrated in FIG. 7. In other words, the sheet folder controller 210 causes the fourth sheet conveyor R4 and the first sheet folder F1 to rotate in the direction to convey the sheet bundle Q such that the direction of conveyance of the sheet bundle Q is changed to the direction in which the sheet bundle Q is conveyed to the first sheet folder F1 (see FIG. 12). Due to the reverse rotations of the fourth sheet conveyor R4, the conveyance of the sheet bundle Q is changed to the "folding conveyance" in which the first sheet conveyor R1 conveys the sheet bundle Q in the reverse direction that is opposite to the sheet conveyance direction.

Figure 13:
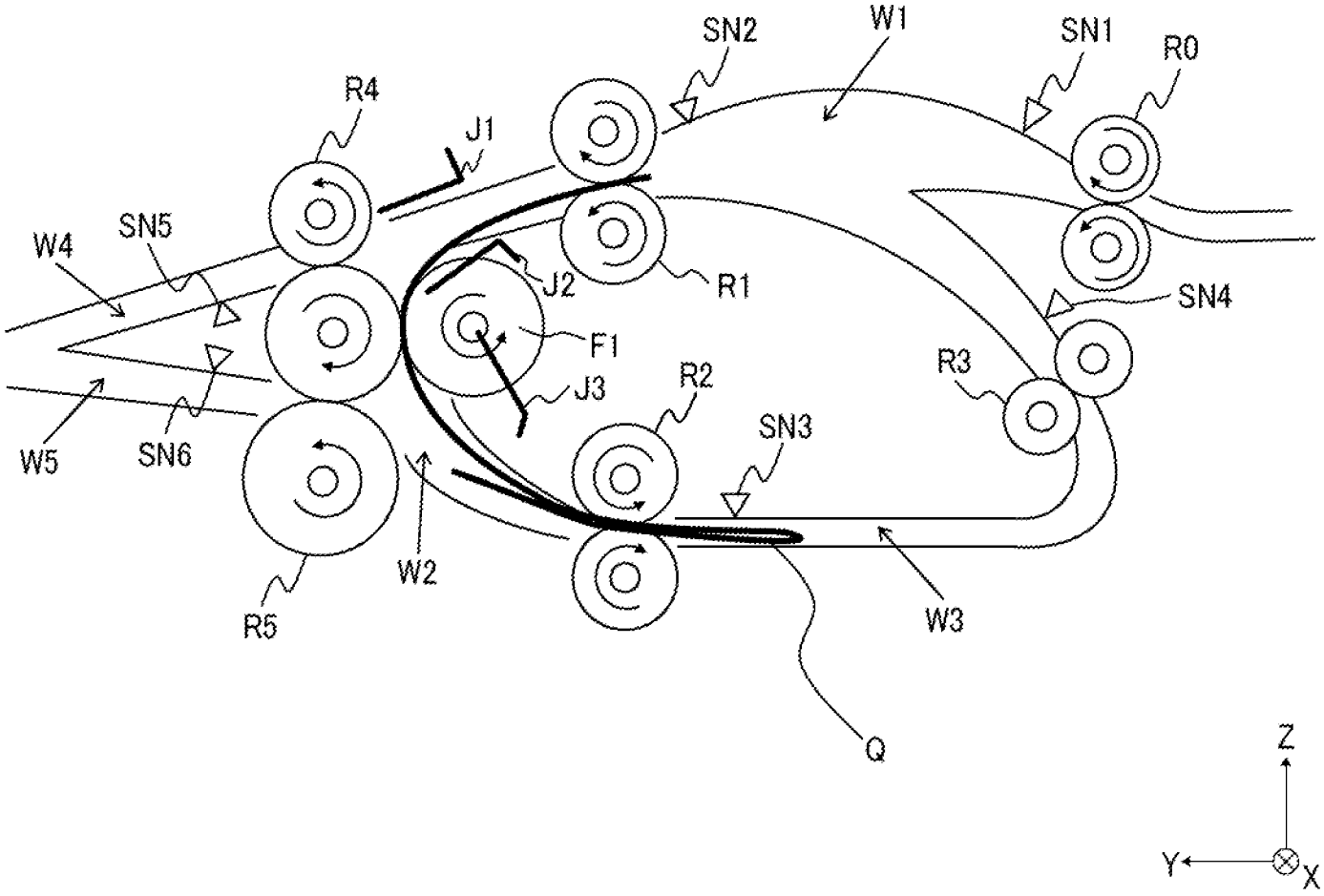
FIG. 13 is an enlarged view of the internal configuration of the sheet folder, illustrating the subsequent process of the folding conveyance in the sheet folder of FIG. 12.

As illustrated in FIG. 13, in the folding conveyance, the first sheet conveyor R1 continues to rotate in the same direction as the rotational direction illustrated in FIG. 9. As a result, a bend (to be more specific, a bent portion) is formed in the sheet bundle Q before the nip region of the first sheet folder F1. This bend (bent portion) of the sheet bundle Q enters the nip region of the first sheet folder F1 so that a "first folding operation" is performed on the sheet bundle Q. As a result, the first fold is formed in the sheet bundle Q.

The sheet bundle Q on which the first folding operation is performed comes to the circulation conveyance in which the sheet bundle Q is conveyed to the second sheet conveyance passage W2. At this time, the sheet bundle Q is conveyed along the inclination of the downward slope of the second sheet conveyance passage W2, where the third sheet detection sensor SN3 detects the leading end of the sheet bundle Q on which the first folding operation has been performed in the circulation conveyance. The sheet folder controller 210 further conveys the sheet bundle Q in the same direction based on the detection timing of the third sheet detection sensor SN3 and controls the conveyance of the sheet bundle Q so that the leading end of the sheet bundle Q in the sheet conveyance direction comes to have a fifth projection amount Δ5.

Figure 14:
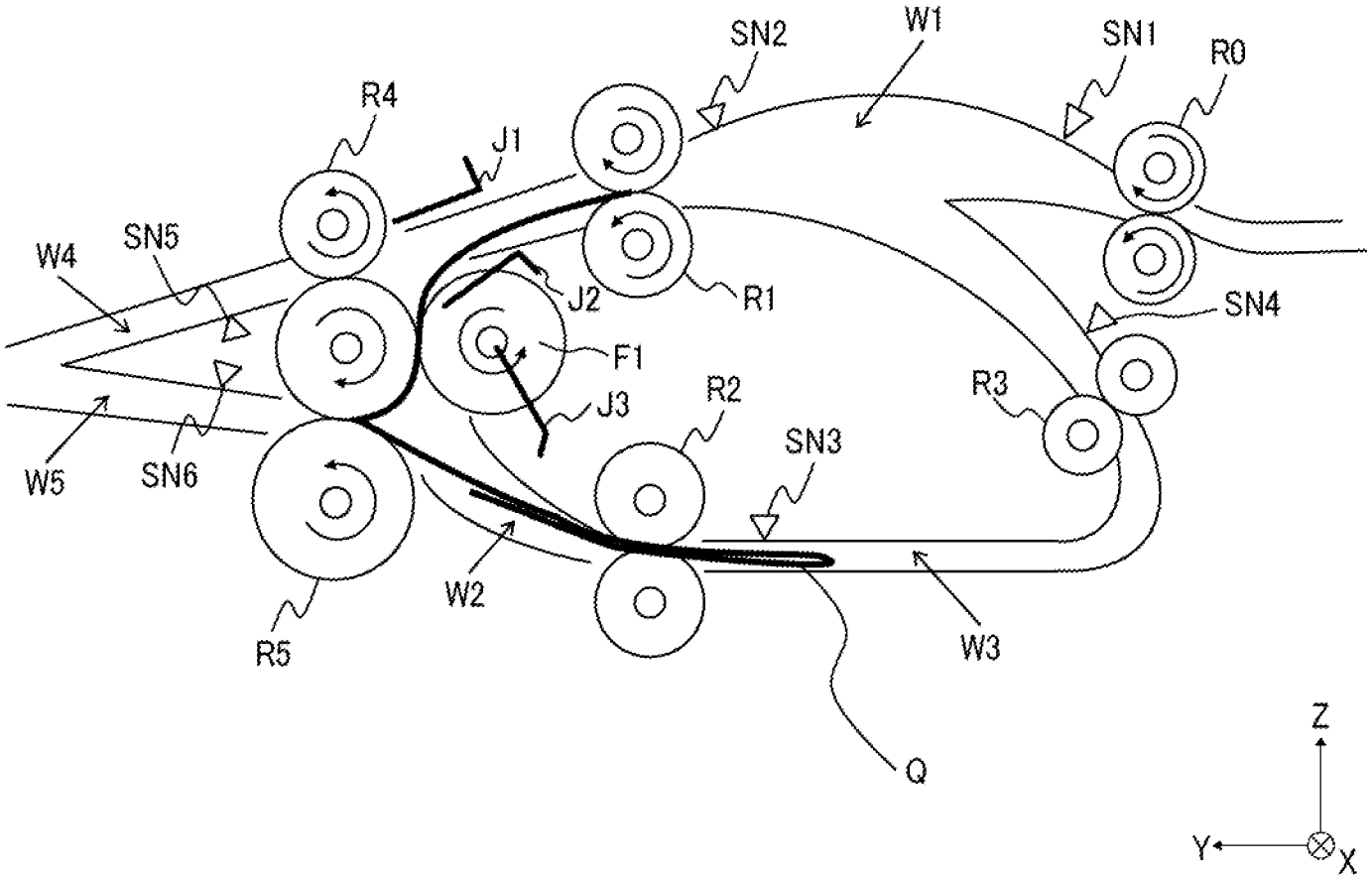
FIG. 14 is an enlarged view of the internal configuration of the sheet folder, illustrating the subsequent process of the folding conveyance in the sheet folder of FIG. 13.

Then, the sheet folder controller 210 causes the second sheet conveyor R2 to rotate in the reverse direction that is opposite to the rotational direction illustrated in FIG. 13 while causing the fourth sheet conveyor R4 and the first sheet folder F1 to rotate in the sheet conveyance direction. This reverse rotation of the second sheet conveyor R2 conveys the sheet P (i.e., the sheet bundle Q) in the reverse direction. On the other hand, the sheet folder controller 210 causes the fourth sheet conveyor R4 and the first sheet folder F1 to continue to rotate in the direction illustrated in FIG. 13 to convey the sheet P (i.e., the sheet bundle Q). As a result, as illustrated in FIG. 14, a bend (bent portion) is formed in the sheet bundle Q before the nip region of the fifth sheet conveyor R5 that also functions as the second sheet folder F2. This bend (bent portion) of the sheet bundle Q enters the nip region of the fifth sheet conveyor R5, so that the fifth sheet conveyor R5 (the second sheet folder F2) performs a second folding operation to form a second fold in the sheet bundle Q.

The sheet bundle Q on which the second folding operation is performed passes through the fifth sheet conveyance passage W5 toward the ejection tray 24 (see FIG. 4). The fourth projection amount Δ4 and the fifth projection amount Δ5 are determined based on the total length of the sheet P and a folding method set for the sheet P (the sheet bundle Q). Based on this setting, the sheet folder controller 210 determines the fourth projection amount Δ4 and the fifth projection amount Δ5 depending on the amount of rotations of the second sheet conveyor R2 (i.e., the number of driving steps of the drive motor).

When the sheet folder 200 performs the letter fold-out operations on the sheet P, the first folding operation in which the sheet P is folded outside is performed at a position corresponding to one third (⅓) on one side of the entire length of the sheet P from the leading end of the sheet P in the sheet conveyance direction. Then, the second folding operation in which the sheet P is folded inside is performed at a position corresponding to one third (⅓) on the other side of the entire length of the sheet P. On the other hand, when the sheet folder 200 performs the letter fold-in operation on the sheet P, the first folding operation in which the sheet P is folded outside is performed at a position corresponding to two thirds (⅔) on one side of the entire length of the sheet P from the leading end of the sheet P in the sheet conveyance direction, and the second folding operation in which the sheet P is folded inside is performed at a position corresponding to one third (⅓) on the other side of the entire length of the sheet P.

The sheet bundle Q on which the second folding operation is performed is conveyed by the fifth sheet conveyor R5 to the downstream side in the sheet conveyance direction via the fifth sheet conveyance passage W5.

Configuration of Conveyor

Figure 15A:
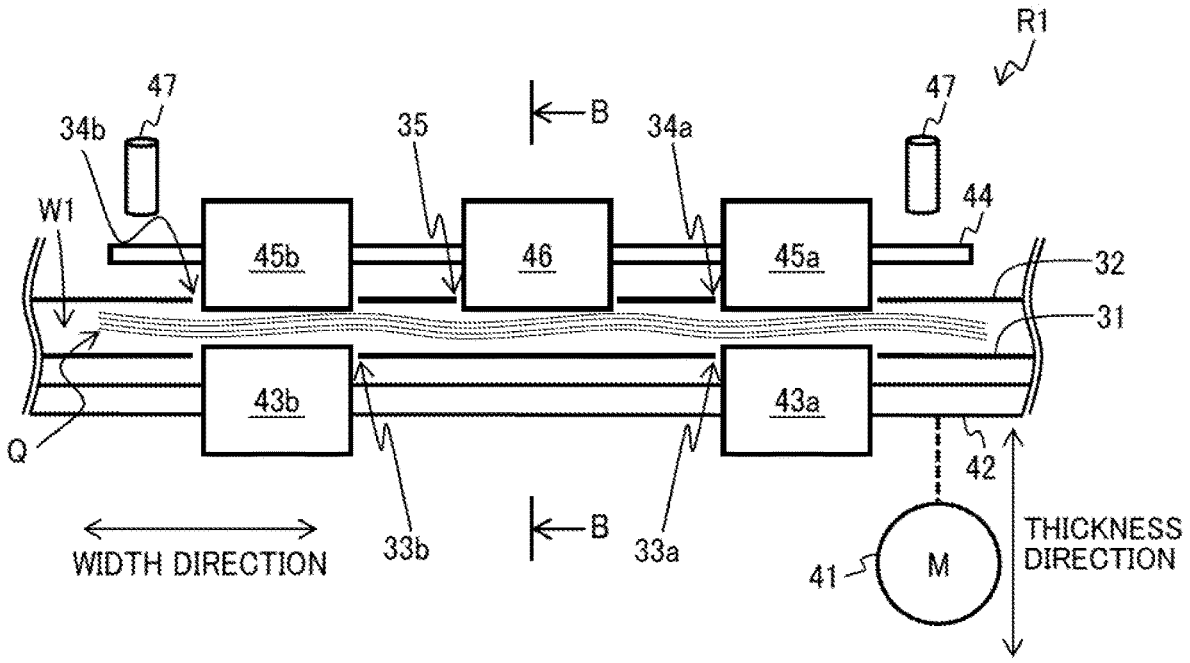
FIG. 15A is a diagram illustrating the conveyor viewed from a sheet conveyance direction of a sheet.
Figure 15B:
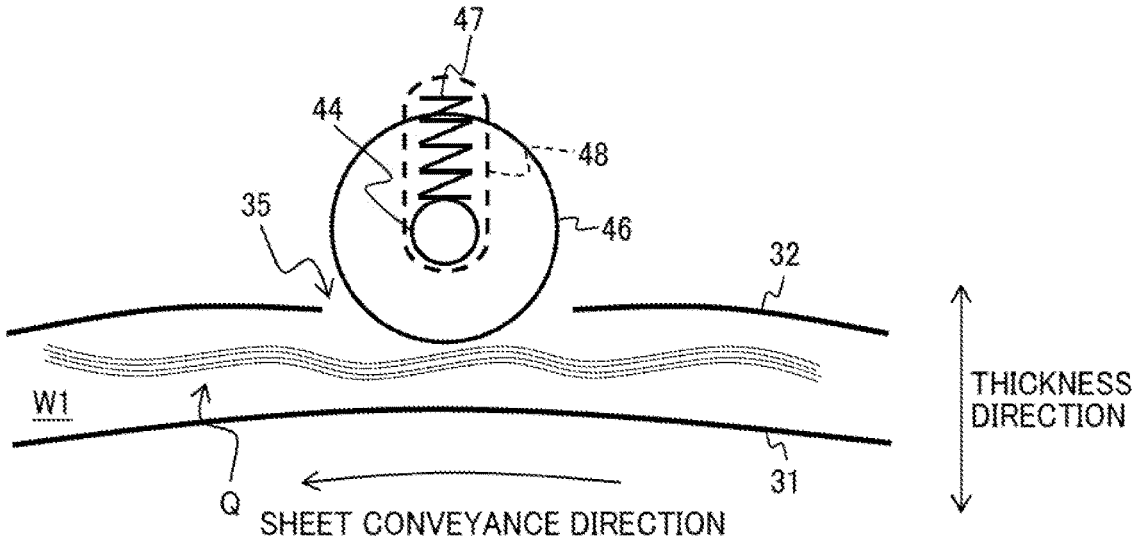
FIG. 15B is a diagram illustrating the conveyor viewed from a width direction of the sheet.

A description is now given of a specific configuration of the conveyor, with reference to FIGS. 15A and 15B.

FIG. 15A is a diagram illustrating the conveyor viewed from a sheet conveyance direction of the sheet P.

FIG. 15B is a diagram illustrating the conveyor viewed from a width direction of the sheet P.

The following describes the configuration of the first sheet conveyor R1. However, the configuration may be commonly applied to the second sheet conveyor R2 to the eighth sheet conveyor R8, and the first sheet folder F1. A direction orthogonal to the sheet conveyance direction of the sheet P and to the direction of thickness (i.e., the thickness direction) of the sheet P is defined as a "width direction of the sheet P" (or simply as the "width direction").

As illustrated in FIGS. 15A and 15B, the first sheet conveyance passage W1 is defined by the first guide plate 31 and the second guide plate 32. The first guide plate 31 and the second guide plate 32 are disposed facing each other in the width direction of the sheet P. The first guide plate 31 and the second guide plate 32 illustrated in FIGS. 15A and 15B define a curved portion of the first sheet conveyance passage W1. The first guide plate 31 defines the inner side of the first sheet conveyance passage W1 in the radial direction, and the second guide plate 32 defines the outer side of the first sheet conveyance passage W1 in the radial direction. The first guide plate 31 and the second guide plate 32 illustrated in FIGS. 15A and 15B may define a flat portion of the first sheet conveyance passage W1.

Further, the first guide plate 31 has first openings 33*a* and 33*b*. The first openings 33*a* and 33*b* penetrate through the first guide plate 31 in the thickness direction of the sheet bundle Q at positions spaced apart from each other by a predetermined distance in the width direction. The second guide plate 32 has second openings 34*a* and 34*b* and a third opening 35. The second openings 34*a* and 34*b* and the third opening 35 penetrate the second guide plate 32 in the thickness direction of the sheet bundle Q at positions spaced apart from each other by the predetermined distance in the width direction. The first opening 33*a* and the second opening 34*a* are disposed at respective positions facing each other in the thickness direction of the sheet bundle Q. Similarly, the first opening 33*b* and the second opening 34*b* are disposed at respective positions facing each other in the thickness direction of the sheet bundle Q. On the other hand, the third opening 35 is formed at a position shifted from the second openings 34*a* and 34*b* in the width direction. The third opening 35 according to the present embodiment is formed between two openings, which are the second openings 34*a* and 34*b*, in the width direction. The numbers of first openings 33*a* and 33*b*, the second openings 34*a* and 34*b*, and the third opening 35 are not limited to the aforementioned examples.

The first sheet conveyor R1 includes a drive motor 41, a drive shaft 42, drive rollers 43*a* and 43*b*, a support shaft 44, first driven rollers 45*a* and 45*b*, a second driven roller 46, and an adjuster 47.

The drive motor 41 is a drive source that generates a driving force to rotate the drive shaft 42 (in other words, the drive rollers 43*a* and 43*b*). The drive shaft 42 extends in the width direction on the opposite side from the first sheet conveyance passage W1 across the first guide plate 31 (in other words, on the outer side of the first sheet conveyance passage W1). The drive rollers 43*a* and 43*b* are disposed apart from each other with a given space and supported by the drive shaft 42. Further, parts of the drive rollers 43*a* and 43*b* protrude into the first sheet conveyance passage W1 through the first openings 33*a* and 33*b*. As the drive motor 41 is rotated, the drive shaft 42 and the drive rollers 43*a* and 43*b* are rotated together.

The support shaft 44 extends in the width direction on the opposite side from the first sheet conveyance passage W1 across the second guide plate 32 (in other words, on the outer side of the first sheet conveyance passage W1). As illustrated in FIG. 15B, both ends of the support shaft 44 (only one end is illustrated in FIG. 15B) are supported by respective slots 48 provided in the frame of the sheet folder 200. Each of the slots 48 extends in the thickness direction of the sheet P or the sheet bundle Q in the first sheet conveyance passage W1. In other words, the support shaft 44 (in other words, the first driven rollers 45*a* and 45*b* and the second driven roller 46 supported by the support shaft 44) is movable in the thickness direction.

The first driven rollers 45*a* and 45*b* and the second driven roller 46 are disposed apart from each other at given spaces in the width direction and are rotatably supported by the support shaft 44. The second driven roller 46 according to the present embodiment is rotatably supported by the support shaft 44 between two driven rollers, which are the first driven rollers 45*a* and 45*b*, in the width direction. Further, a part of the first driven roller 45*a* protrudes into the first sheet conveyance passage W1 through the second opening 34*a*. Similarly, a part of the first driven roller 45*b* protrudes into the first sheet conveyance passage W1 through the second opening 34*b*. Further, a part of the second driven roller 46 protrudes into the first sheet conveyance passage W1 through the third opening 35. The first driven rollers 45*a* and 45*b* and the second driven roller 46 according to the present embodiment have the same shape.

The drive roller 43*a* and the first driven roller 45*a* are disposed facing each other with a space into which the sheet P or the sheet bundle Q can enter. Similarly, the drive roller 43*b* and the first driven roller 45*b* are disposed facing each other with a space into which the sheet P or the sheet bundle Q can enter. In other words, the drive rollers 43*a* and 43*b* and the first driven rollers 45*a* and 45*b* can hold (nip) the sheet P or the sheet bundle Q in the first sheet conveyance passage W1. On the other hand, the second driven roller 46 is disposed at a position shifted from the first driven rollers 45*a* and 45*b* in the width direction (in the present embodiment, the second driven roller 46 is disposed between the first driven rollers 45*a* and 45*b* in the width direction).

As the drive motor 41 is rotated while the drive rollers 43*a* and 43*b* and the first driven rollers 45*a* and 45*b* nip the sheet P or the sheet bundle Q, the sheet P or the sheet bundle Q is conveyed along the first sheet conveyance passage W1. In other words, the first driven rollers 45*a* and 45*b* are driven to rotate while contacting the sheet P or the sheet bundle Q conveyed through the first sheet conveyance passage W1.

Further, the second driven roller 46 is driven to rotate while contacting the sheet P or the sheet bundle Q conveyed in the first sheet conveyance passage W1.

The adjuster 47 adjusts the projection amounts of the first driven rollers 45*a* and 45*b* and the second driven roller 46 with respect to the first sheet conveyance passage W1 in accordance with the thicknesses of the sheet P or the sheet bundle Q in the first sheet conveyance passage W1. The adjuster 47 according to the present embodiment is a coil spring (serving as a biasing member) that biases the support shaft 44 in a direction in which the support shaft 44 approaches the first sheet conveyance passage W1. Accordingly, the nip forces of the drive rollers 43*a* and 43*b* and the first driven rollers 45*a* and 45*b* and the pressing force of the second driven roller 46 to the sheet P or the sheet bundle Q are adjusted in accordance with the thicknesses of the sheet P or the sheet bundle Q. However, the specific configuration of the adjuster 47 is not limited to the above-described example.

According to the above-described embodiment, the following operational effects, for example, are achieved.

According to the above-described embodiment, the second driven roller 46 contacts the sheet P or the sheet bundle Q conveyed in the first sheet conveyance passage W1. For this reason, the sheet P or the sheet bundle Q is prevented from being conveyed while contacting the second guide plate 32. Further, the second driven roller 46 is pressed against the sheet P or the sheet bundle Q with an appropriate pressing force to be rotated. This configuration can prevent an increase in conveyance resistance of the sheet P or the sheet bundle Q. As a result, the sheet P or the sheet bundle Q can be prevented from being scratched or wrinkled by being rubbed against the second guide plate 32.

Further, according to the above-described embodiment, the first driven rollers 45*a* and 45*b* and the second driven roller 46 have the same shape. Due to such a configuration, the pressing force by the first driven rollers 45*a* and 45*b* and the second driven roller 46 can be made uniform in the width direction of the sheet P or the sheet bundle Q. In addition, if the first driven rollers 45*a* and 45*b* and the second driven roller 46 are manufactured by the same mold, the variation in the dimensional accuracy of each product is reduced, and the stable quality of conveyance is achieved.

Further, according to the above-described embodiment, the first driven rollers 45*a* and 45*b* and the second driven roller 46 share the support shaft 44, in other words, are supported by the common support shaft 44. Due to such a configuration, the configuration of the adjuster 47 can be simpler.

Alternatively, the first driven rollers 45*a* and 45*b* and the second driven roller 46 may be rotatably supported by respective independent support shafts.

Further, according to the above-described embodiment, the second driven roller 46 is brought into contact with the sheet P or the sheet bundle Q from the outer side in the radial direction of the curved first sheet conveyance passage W1. This configuration can effectively prevent the sheet P or the sheet bundle Q from spreading outward in the radial direction and coming into contact with the second guide plate 32. However, the second guide plate 32 may define the inner side of the first sheet conveyance passage W1 in the radial direction. In other words, the second driven roller 46 may contact the sheet P or the sheet bundle Q from the radially inner side of the curved first sheet conveyance passage W1.

Modification 1

Figure 16:
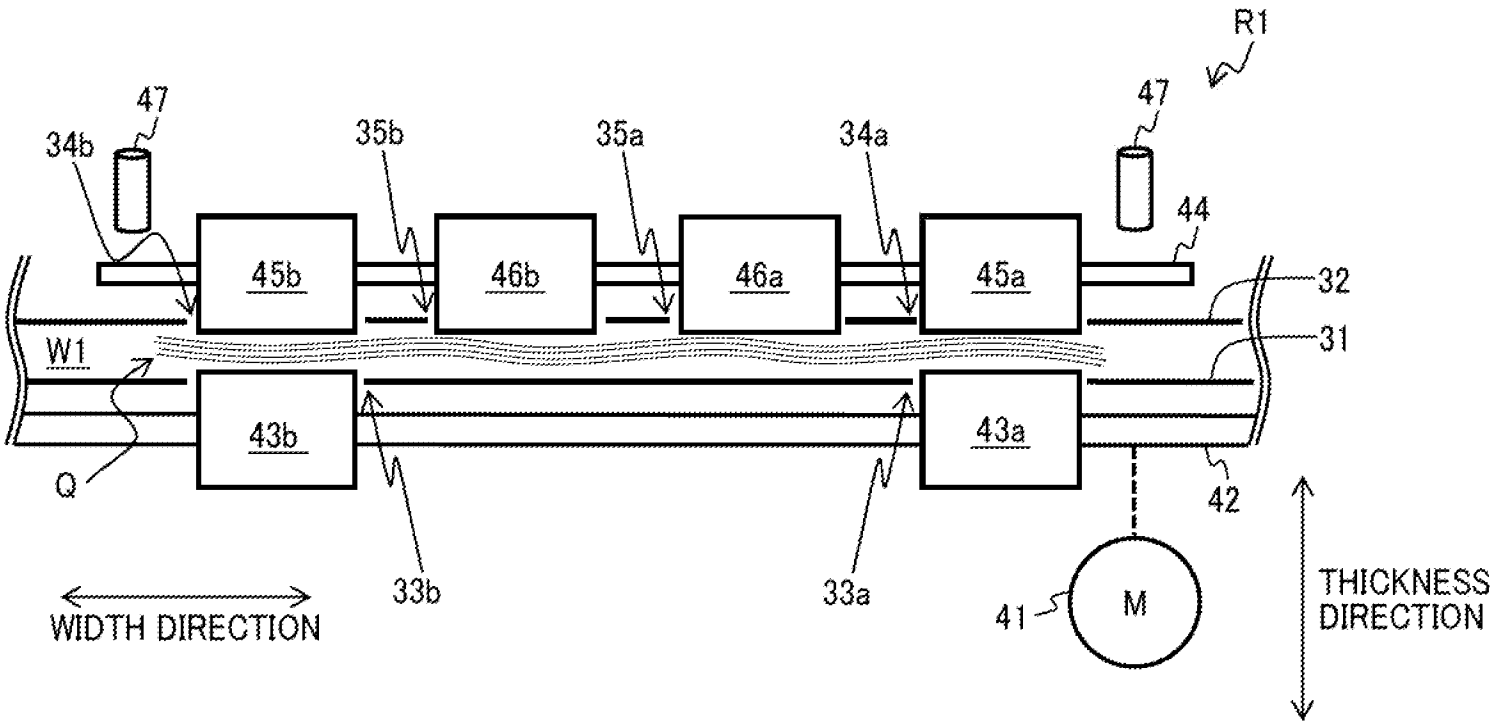
FIG. 16 is a diagram illustrating the conveyor according to a first modification, viewed from the sheet conveyance direction.

A description is given of the conveyor according to a first modification, with reference to FIG. 16.

FIG. 16 is a diagram illustrating the conveyor according to the first modification, viewed from the sheet conveyance direction.

Detailed descriptions will be omitted of common features of the above-described embodiment and the present modification. The following description is mainly given of the differences between the above-described embodiment and the present modification. The following describes the configuration of the first sheet conveyor R1. However, the configuration may be commonly applied to the second sheet conveyor R2 to the eighth sheet conveyor R8, and the first sheet folder F1.

As illustrated in FIG. 16, multiple third openings 35*a* and 35*b* are formed in the second guide plate 32 according to the first modification. Further, the multiple third openings 35*a* and 35*b* are formed between the two openings, which are the second openings 34*a* and 34*b*, in the width direction. Moreover, the multiple third openings 35*a* and 35*b* are spaced apart from each other with a given space in the width direction.

Further, the first conveying unit R1 according to Modification 1 includes multiple second driven rollers 46*a* and 46*b*. Moreover, the second driven rollers 46*a* and 46*b* are disposed between two first driven rollers, which are the first driven rollers 45*a* and 45*b*, in the width direction. Further, a part the second driven roller 46*a* protrudes into the first sheet conveyance passage W1 through the corresponding third opening 35*a*. Similarly, apart the second driven roller 46*b* protrudes into the first sheet conveyance passage W1 through the corresponding third opening 35*b*. However, the number of the third openings (35*a* and 35*b*) and the number of the second driven rollers (46*a* and 46*b*) are not limited to two and may be three or more.

According to Modification 1, the multiple second driven rollers 46*a* and 46*b* are driven to rotate in contact with the sheet P or the sheet bundle Q with a given space in the width direction. Accordingly, the sheet folder 200 having a space with a relatively long length between the two drive rollers 43*a* and 43*b* (in other words, the two first driven rollers 45*a* and 45*b*) can effectively prevent the sheet P or the sheet bundle Q from coming into contact with the second guide plate 32.

Modification 2

Figure 17:
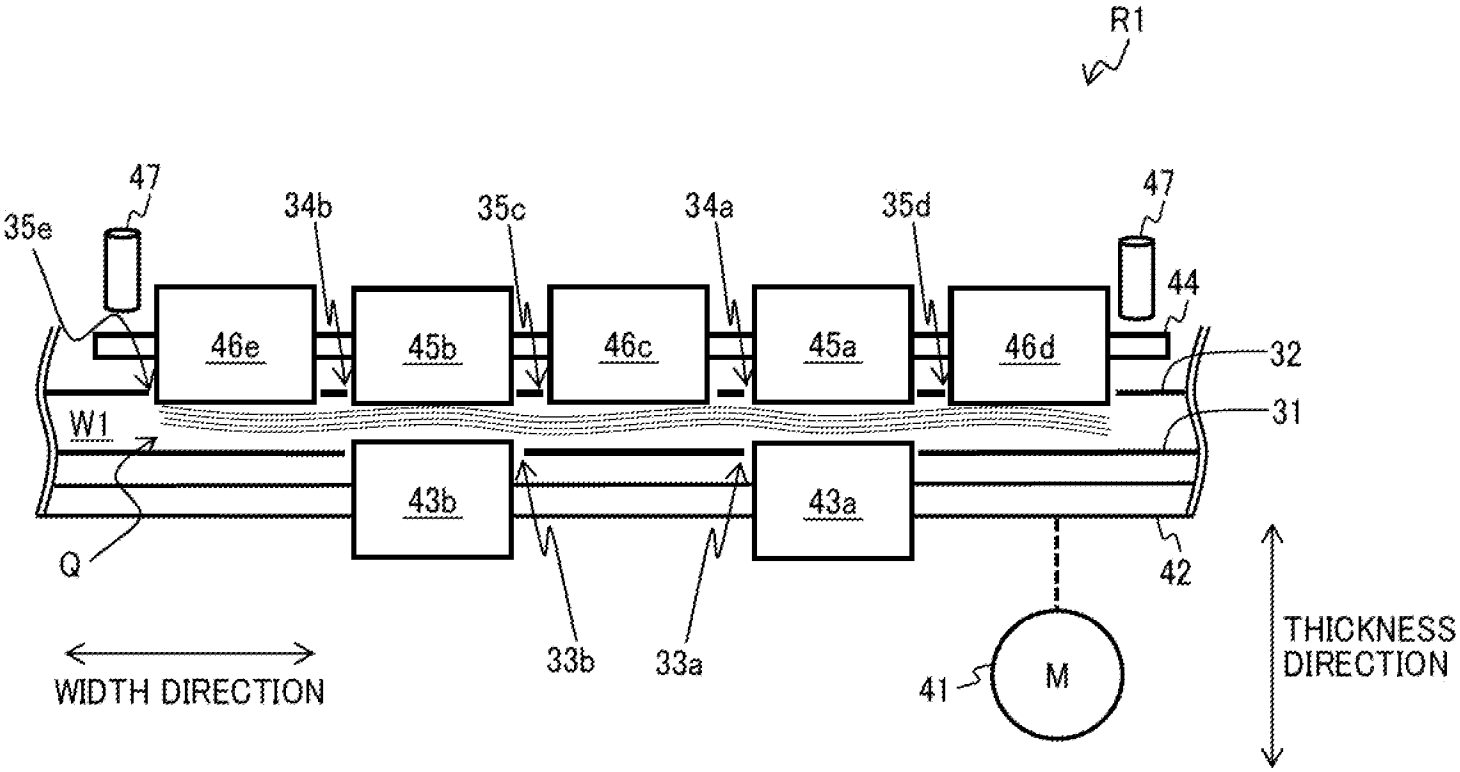
FIG. 17 is a diagram illustrating the conveyor according to a second modification, viewed from the sheet conveyance direction.

A description is given of the conveyor according to a second modification, with reference to FIG. 17.

FIG. 17 is a diagram illustrating the conveyor according to the second modification, viewed from the sheet conveyance direction.

Detailed descriptions will be omitted of common features of the above-described embodiment and the present modification. The following description is mainly given of the differences between the above-described embodiment and the present modification. The following describes the configuration of the first sheet conveyor R1. However, the configuration may be commonly applied to the second sheet conveyor R2 to the eighth sheet conveyor R8, and the first sheet folder F1.

As illustrated in FIG. 17, multiple third openings 35*c*, 35*d*, and 35*e* are formed in the second guide plate 32 according to the second modification. A third opening 35*c* is formed between the two openings, which are the second openings 34*a* and 34*b*, in the width direction. Further, third openings 35*d* and 35*e* are disposed on the outer side of the two second openings 34*a* and 34*b* in the width direction (i.e., on the side opposite to the third opening 35*c* across the second openings 34*a* and 34*b*). Moreover, the second openings 34*a* and 34*b* and the third openings 35*c*, 35*d*, and 35*e* are spaced apart from each other with given spaces in the width direction.

Further, the first conveying unit R1 according to Modification 2 includes multiple second driven rollers 46*c*, 46*d*, and 46*e*. Moreover, the second driven roller 46*c* is disposed between two first driven rollers, which are the first driven rollers 45*a* and 45*b*, in the width direction. The second driven rollers 46*d* and 46*e* are disposed on the outer side of the two first driven rollers 45*a* and 45*b* in the width direction (i.e., on the side opposite to the second driven roller 46*c* across the first driven rollers 45*a* and 45*b*). Further, a part the second driven roller 46*c* protrudes into the first sheet conveyance passage W1 through the corresponding third opening 35*c*. Similarly, a part the second driven roller 46*d* protrudes into the first sheet conveyance passage W1 through the corresponding third opening 35*d*, and a part the second driven roller 46*e* protrudes into the first sheet conveyance passage W1 through the corresponding third opening 35*e*. However, the numbers of the third openings 35*c*, 35*d*, and 35*e* and the numbers of the second driven rollers 46*c*, 46*d*, and 46*e* are not limited to three.

According to Modification 2, the second driven rollers 46*d* and 46*e* are disposed on the outer side of the first driven rollers 45*a* and 45*b*. Such a configuration can advantageously achieve an effect that the sheet P or the sheet bundle Q having a large widthwise size can be prevented from coming into contact with the second guide plate 32.

Aspects of the Present Disclosure

Several aspects of the drive device and the image forming apparatus are exemplified as follows.

Aspect 1

In Aspect 1, a sheet processing apparatus includes a first guide plate, a second guide plate, a sheet conveyance passage, and a sheet conveyor. The first guide plate has a first opening. The second guide plate has a second opening and a third opening and disposed facing the first guide plate at a given space in a thickness direction of a sheet. The sheet conveyance passage is defined by the first guide plate and the second guide plate, through which the sheet is conveyed. The sheet conveyor conveys the sheet along the sheet conveyance passage in a sheet conveyance direction. The sheet conveyor includes a drive source, a drive roller, a first driven roller, a second driven roller, and an adjuster. The drive roller protrudes toward the sheet conveyance passage through the first opening, the drive roller to rotate by a driving force of the drive source while contacting the sheet in the sheet conveyance passage. The first driven roller protrude toward the sheet conveyance passage through the second opening and facing the drive roller. The first driven roller is to be rotated with the sheet being conveyed in the sheet conveyance passage while contacting the sheet. The second driven roller protrudes toward the sheet conveyance passage through the third opening at a position shifted from the drive roller in a width direction of the sheet orthogonal to the sheet conveyance direction and the thickness direction and the thickness direction. The second driven roller is to be rotated with the sheet being conveyed in the sheet conveyance passage while contacting the sheet. The adjuster adjusts a protruding amount of the first driven roller and the second driven roller according to a thickness of the sheet in the sheet conveyance passage.

Aspect 2

In Aspect 2, in the sheet processing apparatus according to Aspect 1, the first driven roller and the second driven roller have a same shape.

Aspect 3

In Aspect 3, in the sheet processing apparatus according to Aspect 1 or 2, the sheet conveyor has multiple second driven rollers including the second driven roller.

Aspect 4

In Aspect 4, the sheet processing apparatus according to any one of Aspects 1 to 3 further includes two drive rollers and two first driven rollers. The two drive rollers include the drive roller and disposed apart from each other in the width direction of the sheet. The two first driven rollers include the first driven roller and disposed apart from each other in the width direction of the sheet. The second driven roller is disposed between the two first driven rollers.

Aspect 5

In Aspect 5, the sheet processing apparatus according to any one of Aspects 1 to 3 further includes two drive rollers, two first driven rollers, and multiple second driven rollers. The two drive rollers include the drive roller and disposed apart from each other in the width direction of the sheet. The two first driven rollers include the first driven roller and disposed apart from each other in the width direction of the sheet. The multiple second driven rollers include the second driven roller and disposed an axially outward side of the two first driven rollers.

Aspect 6

In Aspect 6, the sheet processing apparatus according to any one of Aspects 1 to 5 further includes a support shaft extending in the width direction of the sheet. The first driven roller and the second driven roller are rotatably supported by the support shaft.

Aspect 7 In Aspect 7, in the sheet processing apparatus according to Aspect 6, each end of the support shaft is movably supported by a slot formed in a frame of the sheet processing apparatus and extending in the thickness direction of the sheet, and the adjuster includes a biasing member biasing the support shaft toward the sheet conveyance passage.

Aspect 8

In Aspect 8, in the sheet processing apparatus according to any one of Aspects 1 to 7, the sheet conveyance passage is curved, and the second guide plate defines a radially outward side of the sheet conveyance passage.

Aspect 9

In Aspect 9, in the sheet processing apparatus according to any one of Aspects 1 to 8, the first guide plate and the second guide plate define a circulation conveyance passage in which multiple sheets are conveyed one by one at a given time interval to be overlaid to form a sheet bundle.

Aspect 10

In Aspect 10, an image forming apparatus includes an image former to form an image on a sheet, and the sheet processing apparatus according to any one of Aspects 1 to 8 to perform a post-processing operation on the sheet.

Aspect 11

In Aspect 11, an image forming system includes an image forming apparatus including an image former to form an image on a sheet, and the sheet processing apparatus according to Aspect 1 coupled to the image forming apparatus.

Aspect 12

In Aspect 12, a sheet processing apparatus includes a first guide plate, a second guide plate, a sheet conveyance passage, and a sheet conveyor. The first guide plate has a first opening. The second guide plate faces the first guide plate with a given space in a thickness direction of a sheet and has a second opening and a third opening. The sheet conveyance passage is between the first guide plate and the second guide plate. The sheet conveyor conveys the sheet along the sheet conveyance passage in a sheet conveyance direction. The sheet conveyor includes a drive roller, a first driven roller, and a second driven roller. The drive roller protrudes from the first guide plate toward the sheet conveyance passage through the first opening. The first driven roller faces the drive roller and protrudes from the second guide plate toward the sheet conveyance passage through the second opening. The second driven roller protrudes from the second guide plate toward the sheet conveyance passage through the third opening. The second driven roller is disposed at a position shifted from the drive roller in a width direction orthogonal to the sheet conveyance direction and the thickness direction.

Aspect 13

In Aspect 13, the sheet processing apparatus according to Aspect 12 further includes an adjuster to adjust a protruding amount of each of the first driven roller and the second driven roller from the second guide plate according to a thickness of the sheet in the sheet conveyance passage.

Aspect 14

In Aspect 14, according to Aspect 12, the first driven roller and the second driven roller have a same diameter.

Aspect 15

In Aspect 15, the sheet processing apparatus according to any one of Aspects 12 to 14 further includes two drive rollers and two first driven rollers. The two drive rollers include the drive roller and are disposed apart from each other in the width direction. The two first driven rollers include the first driven roller and are disposed apart from each other in the width direction to respectively facing the two drive rollers. The second driven roller is disposed between the two first driven rollers.

Aspect 16

In Aspect 16, the sheet processing apparatus according to any one of Aspects 12 to 14 further includes two drive rollers, two first driven rollers, and an additional second driven roller. The two drive rollers include the drive roller and are disposed apart from each other in the width direction. The two first driven rollers include the first driven roller and are disposed apart from each other in the width direction to respectively facing the two drive rollers. The additional second driven roller includes the second driven roller and is disposed outside the two first driven rollers in the width direction.

Aspect 17

In Aspect 17, the sheet processing apparatus according to any one of Aspects 12 to 16 further includes a support shaft extending in the width direction. The first driven roller and the second driven roller are rotatable around the support shaft.

Aspect 18

In Aspect 18, according to Aspect 17, the support shaft is movable in the thickness direction, and the adjuster includes a biasing member biasing the support shaft toward the sheet conveyance passage in the thickness direction.

Aspect 19

In Aspect 19, according to any one of Aspects 12 to 18, each of the first guide plate and the second guide plate has a curved part defining a curved part of the sheet conveyance passage, and the curved part of the second guide plate defines a radially outward side of the curved part of the sheet conveyance passage.

Aspect 20

In Aspect 20, an image forming apparatus includes the sheet processing apparatus according to any one of Aspects 12 to 19, and an image former to form an image on the sheet. The sheet processing apparatus performs a post-processing operation on the sheet on which the image is formed by the image former.

Aspect 21

In Aspect 21, an image forming system includes the sheet processing apparatus according to any one of Aspects 12 to 19, and an image forming apparatus coupled to the sheet processing apparatus. The image forming apparatus forms an image on the sheet.

The present disclosure is not limited to specific embodiments described above, and numerous additional modifications and variations are possible in light of the teachings within the technical scope of the appended claims. While the above-described embodiments are preferred examples, those skilled in the art will readily conceive various modifications from those disclosed herein. Such modifications are also included in the technical scope of the present disclosure.

The present disclosure is not limited to specific embodiments described above, and numerous additional modifications and variations are possible in light of the teachings within the technical scope of the appended claims. It is therefore to be understood that, the disclosure of this patent specification may be practiced otherwise by those skilled in the art than as specifically described herein, and such, modifications, alternatives are within the technical scope of the appended claims. Such embodiments and variations thereof are included in the scope and gist of the embodiments of the present disclosure and are included in the embodiments described in claims and the equivalent scope thereof.

The effects described in the embodiments of this disclosure are listed as the examples of preferable effects derived from this disclosure, and therefore are not intended to limit to the embodiments of this disclosure.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of this disclosure and are included in the scope of the invention recited in the claims and its equivalent.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

What is claimed is:

1. A sheet processing apparatus comprising:

a first guide plate having a plurality of first openings;

a second guide plate facing the first guide plate with a given space in a thickness direction of a sheet, the second guide plate having a plurality of second openings and a third opening;

a sheet conveyance passage between the first guide plate and the second guide plate; and a sheet conveyor to convey the sheet along the sheet conveyance passage in a sheet conveyance direction, the sheet conveyor including:

a plurality of drive rollers protruding from the first guide plate toward the sheet conveyance passage through the plurality of first openings;

a plurality of first driven rollers facing the plurality of drive rollers and protruding from the second guide plate toward the sheet conveyance passage through the plurality of second openings; and a second driven roller protruding from the second guide plate toward the sheet conveyance passage through the third opening at such a position that the second driven roller does not face the plurality of drive rollers, and the second driven roller disposed at a position shifted from the drive roller in a width direction orthogonal to the sheet conveyance direction and the thickness direction, wherein the plurality of first driven rollers and the second driven roller are rotatably and commonly supported by a support shaft, said support shaft extending in a width direction.

2. The sheet processing apparatus according to claim 1, further comprising:

an adjuster to adjust a protruding amount of each of the first driven roller and the second driven roller from the second guide plate according to a thickness of the sheet in the sheet conveyance passage.

3. The sheet processing apparatus according to claim 2, wherein:

the support shaft is movable in the thickness direction, and the adjuster includes a biasing member biasing the support shaft toward the sheet conveyance passage in the thickness direction.

4. The sheet processing apparatus according to claim 1, wherein the first driven roller and the second driven roller have a same diameter.

5. The sheet processing apparatus according to claim 1, wherein the sheet conveyor includes multiple second driven rollers including the second driven roller.

6. The sheet processing apparatus according to claim 1, further comprising:

two drive rollers including the drive roller and disposed apart from each other in the width direction; and two first driven rollers including the first driven roller and disposed apart from each other in the width direction to respectively facing the two drive rollers, wherein the second driven roller is disposed between the two first driven rollers.

7. The sheet processing apparatus according to claim 1, further comprising:

two drive rollers including the drive roller and disposed apart from each other in the width direction;

two first driven rollers including the first driven roller and disposed apart from each other in the width direction to respectively facing the two drive rollers; and an additional second driven roller including the second driven roller and disposed outside the two first driven rollers in the width direction.

8. The sheet processing apparatus according to claim 1, wherein:

each of the first guide plate and the second guide plate has a curved part defining a curved part of the sheet conveyance passage, and the curved part of the second guide plate defines a radially outward side of the curved part of the sheet conveyance passage.

9. The sheet processing apparatus according to claim 1, wherein the first guide plate and the second guide plate define a circulation conveyance passage in which multiple sheets are conveyed one by one at a given time interval to be overlaid to form a sheet bundle.

10. An image forming apparatus comprising:

the sheet processing apparatus according to claim 1; and an image former to form an image on the sheet, wherein the sheet processing apparatus performs a post-processing operation on the sheet on which the image is formed by the image former.

11. An image forming system comprising:

the sheet processing apparatus according to claim 1; and an image forming apparatus coupled to the sheet processing apparatus, the image forming apparatus to form an image on the sheet.

12. The sheet processing apparatus according to claim 1, wherein a length of the support shaft in the width direction is longer than a sum of a length in a width direction of the plurality of first driven rollers and a length in a width direction of the second driven roller, and an adjuster biases both end portions of the support shaft that protrude in the width direction from the plurality of first driven rollers and the second driven roller.

13. The sheet processing apparatus according to claim 1, wherein the sheet is a sheet bundle formed by overlaying a plurality of sheets.

14. The sheet processing apparatus according to claim 1, wherein the second driven roller is configured to change a sheet conveyance direction.

15. The sheet processing apparatus according to claim 1, wherein the second driven roller is configured to form a fold on the sheet.

* * * * *